US005767585A

United States Patent [19]

Shiga et al.

[11] Patent Number: 5,767,585

[45] Date of Patent: Jun. 16, 1998

[54] STARTER

[75] Inventors: Tsutomu Shiga, Nukata-gun; Takeshi Araki, Nishikasugai-gun; Nobuyuki Hayashi, Nagoya; Masanori Ohmi, Anjo; Masahiro Katoh, Chiryu; Masami Niimi, Handa, all of Japan

[73] Assignee: Nippondenso Co., Ltd., Japan

[21] Appl. No.: 644,062

[22] Filed: May 9, 1996

Related U.S. Application Data

[63] Continuation-in-part of Ser. No. 567,211, Dec. 5, 1995, Pat. No. 5,610,445, and a continuation of Ser. No. 353,987, Dec. 6, 1994, abandoned.

[30] Foreign Application Priority Data

| | | | |
|---|---|---|---|
| Dec. 27, 1993 | [JP] | Japan | 5-332955 |
| Sep. 19, 1994 | [JP] | Japan | 6-222321 |
| May 10, 1995 | [JP] | Japan | 7-112119 |
| May 19, 1995 | [JP] | Japan | 7-121678 |
| Mar. 18, 1996 | [JP] | Japan | 8-061363 |

[51] Int. Cl.[6] ..... F02N 11/00; F02N 15/06

[52] U.S. Cl. ..... 290/38 R; 290/48; 74/6

[58] Field of Search ..... 290/38 A, 38 B, 290/38 C, 38 D, 38 E, 48; 74/7 R, 7 A, 7 B, 7 C, 7 D, 7 E, 6; 123/179.1, 179.3

[56] References Cited

U.S. PATENT DOCUMENTS

| | | | |
|---|---|---|---|
| 1,330,326 | 2/1920 | McGrath | 74/7 R |
| 1,527,588 | 2/1925 | Kennington | 74/7 R |
| 1,949,698 | 3/1934 | Toulmin, Jr. | 65/38 |
| 2,305,325 | 11/1942 | Janes | 290/38 |
| 2,332,986 | 10/1943 | Buxton | 74/7 R |
| 2,342,632 | 2/1944 | Hood | 290/38 |
| 3,496,759 | 2/1970 | Buxton | 74/7 R |
| 4,737,654 | 4/1988 | Morishita et al. | 290/48 |
| 5,443,553 | 8/1995 | Shiga et al. | 74/7 R |
| 5,508,566 | 4/1996 | Nagao et al. | 290/38 R |
| 5,508,577 | 4/1996 | Shiga et al. | 310/201 |
| 5,596,902 | 1/1997 | McMillan | 74/7 C |
| 5,608,280 | 3/1997 | Tanemoto | 310/239 |
| 5,610,445 | 3/1997 | Shiga et al. | 290/38 R |
| 5,617,758 | 4/1997 | Nishida et al. | 74/7 B |

FOREIGN PATENT DOCUMENTS

| | | |
|---|---|---|
| 91689 | 10/1983 | European Pat. Off. . |
| 2552823 | 4/1985 | France . |
| 1-131872 | 9/1989 | Japan . |
| 390972 | 4/1933 | United Kingdom . |
| 614201 | 12/1948 | United Kingdom . |
| 1145737 | 3/1969 | United Kingdom . |

*Primary Examiner*—Steven L. Stephan
*Assistant Examiner*—Judson H. Jones
*Attorney, Agent, or Firm*—Cushman Darby & Cushman Intellectual Property Group of Pillsbury Madison & Sutro, LLP

[57] ABSTRACT

Rotation of a pinion is regulated by a pinion regulating claw when a starter is actuated. After the pinion engages a ring gear, the regulating claw positioned rearward the pinion regulates the return of the pinion from the ring gear. A thrust bearing including a rolling bearing positioned on the rear face of the pinion absorbs the difference between the rotational speed of the pinion and that of the regulating claw. Such a construction allows only the pinion to move axially and a magnet switch to be made compact and light.

17 Claims, 17 Drawing Sheets

STARTER

CROSS REFERENCE TO RELATED APPLICATIONS

This is a continuation-in-part application of application Ser. No. 08/567,211 filed on Dec. 5, 1995, now U.S. Pat. No. 5,610,445, which is a file wrapper continuation of application Ser. No. 08/353,987 filed on Dec. 6, 1994 now abandoned.

BACKGROUND OF THE INVENTION

1. Field of the Invention

This invention relates to a starter for starting an engine of a motor vehicle.

2. Related Art

Among conventional starters there are those wherein the rotation of a motor is transmitted through a pinion to a ring gear as shown in U.S. Pat. No. 1,941,698 or No. 2, 342,632. In the former, a starter wherein by causing a regulating member to abut with the outer circumferential portion of the pinion, by means of the rotation of a shaft rotated by a motor, by friction between the regulating member and the pinion, the pinion is advanced to the ring gear side and the pinion and the ring gear are caused to mesh is mentioned. In the starter of the latter, by causing a pin of a regulating member to engage with a tooth portion of the pinion, the pinion is prevented from rotating, the pinion is caused to advance to the ring gear side, and the pinion and the ring gear are caused to mesh.

However, when the pinion is caused to mesh with the ring gear side, when the pinion does not mesh with the ring gear and the ring gear abuts with the end surface of the pinion, in conventional starters, although further rotational force of the motor causes the pinion to overcome the friction between the regulating member and the pinion and rotate slightly and the pinion meshes with the ring gear, because frictional force is used, there are problems such as setting of the initial frictional force and that abrasion powder adheres to the sliding surfaces and consequently the durability is poor.

Also, in the latter conventional technology, when the ring gear abuts with the end surface of the pinion, there is the problem that the regulating member suddenly moving through the pitch of the tooth portion of the pinion causes an impact between the pinion and the ring gear, and another constituent member such as a spring is necessary so that the regulating member passes over the tooth peaks of the pinion.

SUMMARY OF THE INVENTION

This invention was made in view of the above situation, and has as an object the provision of a starter of which the simplicity and durability of the pinion rotation regulating mechanism is improved.

According to a starter of the present invention, when a pinion regulating means abuts with a pinion and rotation of an output shaft moves the pinion to a ring gear side and the pinion abuts with a ring gear, the pinion regulating means itself bends and allows the pinion to rotate gradually and mesh with the ring gear and consequently there is no generation of abrasion powder and a simple constitution with few parts can be adopted.

Further, the pinion is rotatable by at least ½ the pinion gear pitch and it is possible to reliably regulate the rotation of the pinion.

Further, axial grooves on the pinion moving means are made more numerous than the pinion gear number, and the pinion can easily engage with the axial grooves.

The pinion regulating means need only hold the pinion with the small force required to regulate the rotation of the pinion, the pinion regulating means can be moved to the pinion side by a magnet switch by way of a cord-shaped member, and the freedom with which the magnet switch can be disposed can be increased.

Further, the pinion regulating means itself can attain pinion return prevention when the pinion has meshed with the ring gear, and the number of parts can be made small and the assembly can be simplified.

The pinion regulating means itself integrally comprises urging means for urging the movement to the opposite side to the pinion, by switching the magnet switch OFF the pinion regulating means automatically moves away from the pinion, and the number of parts can be made small and the assembly can be simplified.

Until the pinion abuts with the ring gear the limiting means makes the rotation of the output shaft slow and the pinion is moved to the ring gear side slowly, and it is not necessary to make the rigidity of the pinion regulating means itself strong, and it is possible to make the shock of when the pinion abuts with the ring gear small.

By part of the pinion regulating means having a bar-like elastic regulating portion, the regulating portion can reliably bend.

By holding the washer rotatably on the end surface of the pinion, even when the pinion is over-run by the ring gear and rotates at high speed, because the washer is rotatable with respect to the pinion, there is little wear on the abutting portion of the regulating portion, and the durability can be increased.

The washer is heat-treated simultaneously with the pinion, and it is possible to dispense with a process for making the hardness of the washer above a predetermined value.

By the movement of the plunger of the magnet switch, by causing the regulating portion to abut with the pinion while causing the elastic portion to deform, while causing the regulating portion to abut with the pinion, and when the plunger returns, by the elastic force of the elastic portion, the regulating portion can be reliably moved away from the pinion.

DETAILED DESCRIPTION OF THE PRESENTLY PREFERRED EMBODIMENTS

Next, the starter of this invention will be described based on various embodiments shown in FIG. 1 through FIG. 22.

First Embodiment

Figure 1:
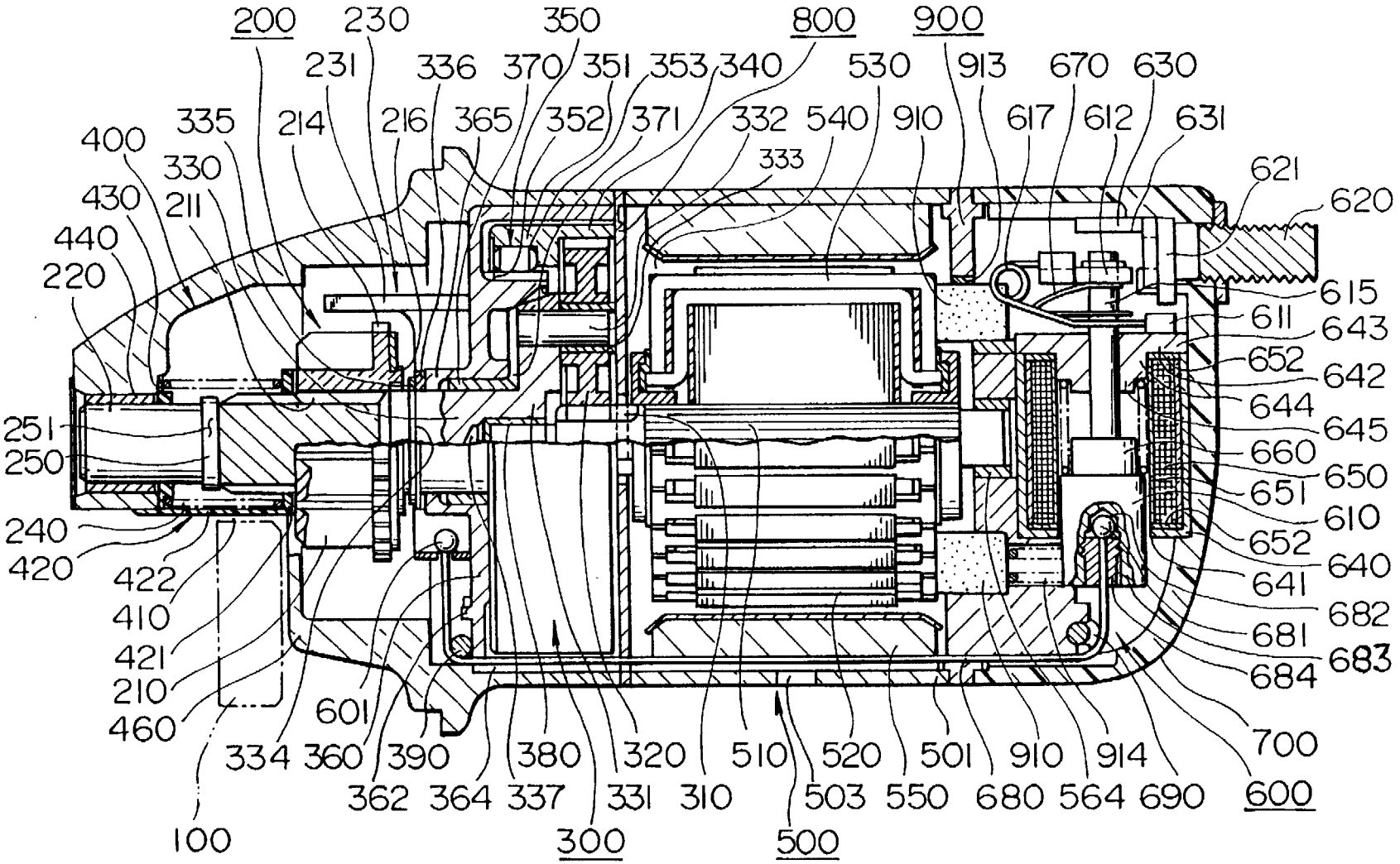
FIG. 1 is a sectional side view showing the first embodiment of a starter of the present invention.

As shown in FIG. 1, a starter can be generally divided into a housing 400 containing a pinion 200 which meshes with a ring gear 100 mounted on an engine (not shown) and a planetary gear speed reduction mechanism 300, a motor 500, and an end frame 700 containing a magnet switch 600. Inside the starter, the housing 400 and the motor 500 are separated by a motor spacer wall 800, and the motor 500 and the end frame 700 are separated by a brush holding member 900.

(Pinion 200)

Figure 3A:
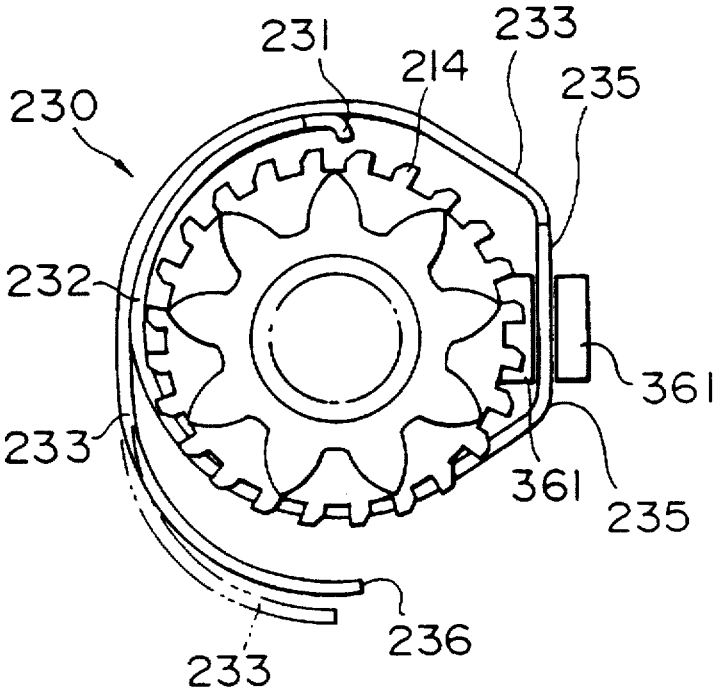
FIGS. 3A and 3B are a front view and a partial sectional side view of a pinion rotation regulating member fitted to a pinion part.
Figure 3B:
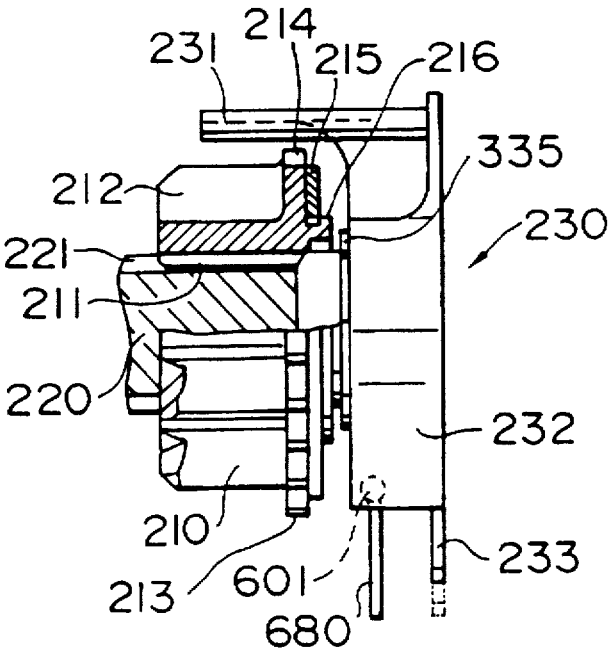

As shown in FIG. 1 and further in detail in FIGS. 3A and 3B, a pinion gear 210 which meshes with the ring gear 100 of the engine is formed on the pinion 200.

A pinion helical spline 211 which mates with a helical spline 221 formed on an output shaft 220 is formed around the inner surface of the pinion gear 210.

On the opposite side of the pinion gear 210 from the ring gear 100 a flange 213 of greater diameter than the external diameter dimension of the pinion gear 210 is formed in circular form. A number of projections 214 greater than the number of outer teeth of the pinion gear 210 are formed around the entire outer circumference of this flange 213. These projections 214 are for a regulating claw 231 of a pinion rotation (return/rotation) regulating member 230 which will be discussed later to mate with. A washer 215 is bent onto the outer peripheral side of an annular portion 216 formed on the rear end of the pinion gear 210 and thereby disposed rotatably and unable to come off in the axial direction on the rear surface of the flange 213.

By the rotatable washer 215 being mounted on the rear surface of the flange 213 of the pinion gear 210 in this way, when a pinion rotation regulating member 230 which will be discussed later drops in behind the pinion gear 210, the front end of a regulating claw 231 of the pinion rotation regulating member 230 abuts with the washer 215. As a result, the rotation of the pinion gear 210 does not directly abut with the regulating claw 231 of the pinion rotation regulating member 230, and the washer 215 rotates relatively and the pinion gear 210 is prevented from being worn by the regulating claw 231 of the pinion rotation regulating member 230.

The pinion gear 210 is urged toward the rear of the output shaft 220 at all times by a return spring 240 consisting of a compression coil spring. The return spring 240 not only urges the pinion gear 210 directly but in this embodiment urges the pinion gear 210 by way of a ring body 421 of a shutter 420 which opens and closes an opening portion 410 of the housing 400 and will be further discussed later.

(Pinion Regulating Member 230)

Figure 2:
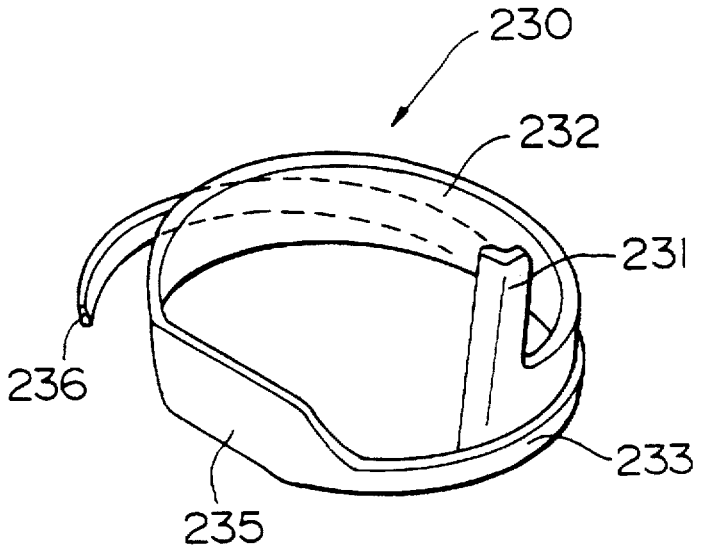
FIG. 2 is a perspective view of a pinion rotation regulating member.

A pinion regulating member 230 constituting pinion moving means which not only moves the pinion 200 but also regulates both rotation and return of the pinion in this embodiment, as shown in FIG. 2 and FIGS. 3A and 3B in detail, is a sheet spring member wound through approximately 3/2 (i.e., 1.5) turns of which approximately 3/4 turns is a rotation regulating portion 232 of long axial sheet length and high spring constant and the remaining approximately 3/4 turns is a return spring portion 233 constituting urging means of short axial sheet length and low spring constant.

A regulating claw 231 which constitutes a regulating portion extending in the axial direction and which mates with the multiple projections 214 formed in the flange 213 of the pinion gear 210 is formed at one end of the rotation regulating portion 232. This regulating claw 231, as well as mating with the projections 214 of the pinion gear 210, in order to increase the rigidity of the regulating claw 231, is formed axially long and is bent radially inward into a cross-sectional L-shape and is bar-like.

The rotation regulating portion 232 is provided with a straight portion 235 which extends vertically. This straight portion 235 is vertically slidably supported by two supporting arms 361 mounted projecting from the front surface of a center bracket 360. That is, the straight portion 235 moving vertically causes the rotation regulating portion 232 to move vertically also.

Also, a sphere 601 of the front end of a cord-shaped member 680 (for example a wire), which will be further discussed later, for transmitting the movement of the magnet switch 600, which will be further discussed later, is in engagement with the position 180° opposite the regulating claw 231 of the rotation regulating portion 232.

The end portion side of the return spring portion 233 has a large curvature of wind and one end portion 236 of the return spring portion 233 abuts with the upper surface of a regulating shelf 362 mounted projecting from a front surface of a lower portion of the center bracket 360.

The operation of the pinion rotation regulating member 230 will now be explained. The cord-shaped member 680 is transmitting means for transmitting the movement of the magnet switch 600 to the regulating claw 231, and the movement of the magnet switch 600 pulls the rotation regulating portion 232 downward and causes the regulating claw 231 to engage with the projections 214 on the flange 213 of the pinion gear 210. At that time, because the end portion 236 of the return spring portion 233 is in abutment with the regulating shelf 362 for position regulating, the return spring portion 233 bends. Because the regulating claw 231 is in engagement with the projections 214 on the pinion gear 210, when the pinion gear 210 starts to be rotated by way of the armature shaft 510 of the motor 500 and the planetary gear speed reduction mechanism 300, the pinion gear 210 advances along the helical spline 221 on the output shaft 220. When the pinion gear 210 abuts with the ring gear 100 and the advance of the pinion gear 210 is obstructed, further rotational force of the output shaft 210 causes the pinion rotation regulating member 230 itself to bend and the pinion gear 210 rotates slightly and meshes with the ring gear 100. When the pinion gear 210 advances, the regulating claw 231 disengages from the projections 214, the regulating claw 231 drops in behind the flange 213 of the pinion gear 210, the front end of the regulating claw 231 abuts with the rear surface of the washer 215 and prevents the pinion gear 210 from retreating under the rotation of the ring gear 100 of the engine.

As the movement of the magnet switch 600 stops and the cord-shaped member 680 stops pulling the rotation regulating portion 232 downward, the action of the return spring portion 233 causes the rotation regulating portion 232 to return to its original position.

In this way, the pinion rotation regulating member 230, although it is one spring member, performs the three operations that are the operation of regulating the rotation of the pinion gear 210 and advancing the pinion gear 210, the operation of dropping in behind the pinion gear 210 and preventing the pinion gear 210 from retracting, and the operation of returning the rotation regulating portion 232. That is, because a plurality of operations are carried out by one part, the number of parts in the starter can be reduced and the assemblability can be improved.

Also, when the pinion rotation regulating member 230 abuts with the pinion gear 210 and by means of the rotation of the output shaft 220, while moving the pinion gear 210 to the ring gear 100 side, the pinion gear 210 abuts with the ring gear 100, because the pinion rotation regulating member 230 itself bends and rotates the pinion gear 210 slightly and causes it to mesh with the ring gear, there is no production of abrasion powder and there are few parts and the construction can be made simple.

Also, the pinion rotation regulating member 230, because the projecting parts of the projections 214 of the pinion gear 210 are more numerous than the teeth of the pinion gear 210, can easily engage with the projections 214.

Because the pinion rotation regulating member 230 need only be held with the small force required to regulate the rotation of the pinion gear 210, it is possible to move it to the pinion gear 210 side by means of the magnet switch 600, using the cord-shaped member 680, and consequently it is possible to increase the freedom with which the magnet switch 600 is disposed.

Also, the pinion rotation regulating member 230 itself can prevent the pinion gear 210 from returning when the pinion gear 210 has meshed with the ring gear 100, and the number of parts can be made small and the assembly can be simplified.

Furthermore, because the pinion rotation regulating member 230 itself integrally comprises the return spring portion 233 constituting urging means urging to the opposite side to the pinion gear, by switching the magnet switch 600 OFF, the pinion rotation regulating member 230 automatically moves away from the pinion gear 210 and the number of parts can be made small and the assembly can be simplified.

By part of the pinion rotation regulating member 230 having the regulating claw 231 constituting the bar-like elastic regulating portion, the pinion rotation regulating member itself can reliably bend.

Also, by the washer 215 being rotatably held on the end surface of the pinion gear 210, even when the pinion gear 210 is over-run by the ring gear 100 and rotates at high speed, because the washer 215 is rotatable with respect to the pinion gear 210, the abutting portion of the regulating claw 231 constituting the regulating portion is not worn much, and the durability can be increased.

(Pinion Stopping Ring 250)

The pinion stopping ring 250 is fixed in a circular groove of rectangular cross-section formed around the output shaft 220. This pinion stopping ring 250 is a piece of steel of rectangular cross-section processed into a circular shape; a substantially S-shaped corrugation 251 (an example of engaging means) is formed at each end, and the convex portion of one is in engagement with the concave portion of the other and the convex portion of the other is in engagement with the concave portion of the first.

(Planetary Gear Speed Reduction Mechanism 300)

The planetary gear speed reduction mechanism 300, as shown in FIG. 1, is speed reducing means for reducing the rotational speed of the output shaft 220 relative to motor 500, which will be further discussed later, and increasing the output torque of the motor 500. The planetary gear speed reduction mechanism 300 is made up of a sun gear 310 formed on the front-side outer periphery of the armature shaft 510 (discussed later) of the motor 500, a plurality of planetary gears 320 which mesh with this sun gear 310 and rotate around the circumference of the sun gear 310, a planet carrier 330 which rotatably supports these planetary gears 320 around the sun gear 310 and is formed integrally with the output shaft 220, and an internal gear 340 which is of a cylindrical shape meshing with the planetary gears 320 at the outer periphery of the planetary gears 320 and is made of resin.

(Overrunning Clutch 350)

The overrunning clutch 350 supports the internal gear 340 rotatably in one direction only (only the direction in which it rotates under the rotation of the engine). The overrunning clutch 350 has a clutch outer 351 constituting a first cylindrical portion integrally formed in the front side of the internal gear 340, a circular clutch inner 352 constituting a second cylindrical portion formed in the rear surface of the center bracket 360 constituting a fixed side covering the front of the planetary gear speed reduction mechanism 300 and disposed facing the clutch outer 351, and a roller 353 accommodated in a roller housing portion formed inclined to the inner surface of the clutch outer 351.

(Center Bracket 360)

Figure 4:
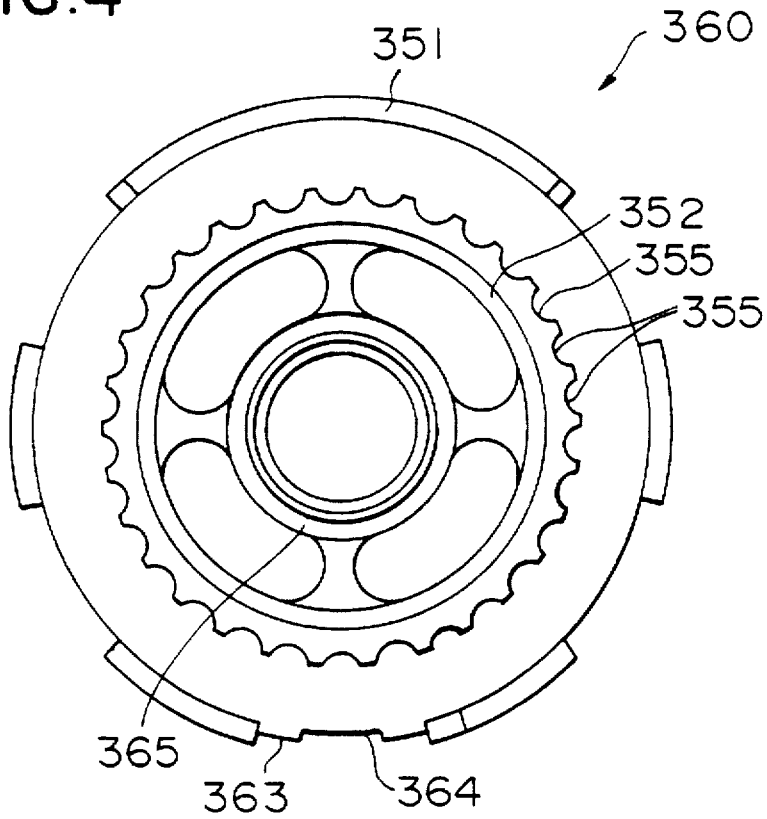
FIG. 4 is a rear view of a center bracket.
Figure 5:
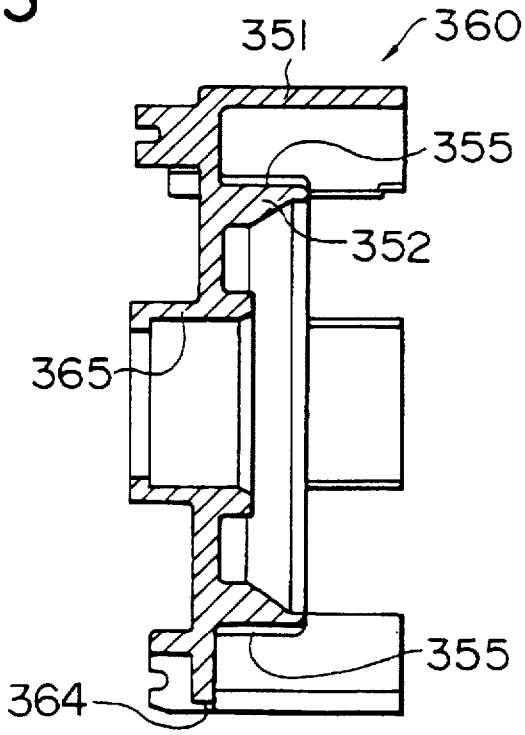
FIG. 5 is a sectional side view of a center bracket.
Figure 6:
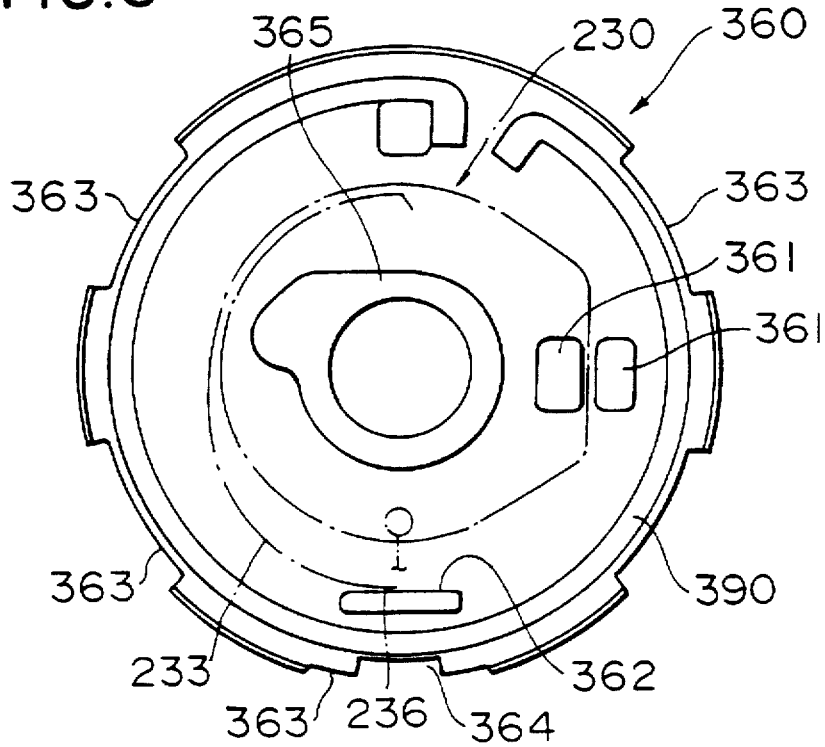
FIG. 6 is a front view of a center bracket.

The center bracket 360 is shown in detail in FIG. 4 through FIG. 6 and is disposed inside the rear end of the housing 400. The housing 400 and the center bracket 360 are linked by a ring spring 390 having one end engaged with the housing 400 and the other end engaged with the center bracket 360 and are arranged in such a way that the rotational reaction received by a clutch inner 352 constituting the overrunning clutch 350 is absorbed by the ring spring 390 and the reaction is not directly transmitted to the housing 400.

Also, two supporting arms 361 which hold the pinion rotation regulating member 230 and a regulating shelf 362 on which the lower end of the pinion rotation regulating member 230 is loaded are mounted on the front surface of the center bracket 360. Further, a plurality of cutout portions 363 which mate with convex portions (not shown in the drawings) on the inner side of the housing 400 are formed around the center bracket 360. The upper side cutout portions 363 are used also air passages for guiding air from inside the housing 400 into a yoke 501. Also, a concave portion 364 through which the cord-shaped member 680 (discussed later) passes in the axial direction is formed at the lower end of the center bracket 360.

(Planet Carrier 330)

The planet carrier 330 is provided at its rear end with a flange-like projecting portion 331 which extends radially in order to support the planetary gears 320. Pins 332 extending rearward are fixed to this flange-like projecting portion 331, and these pins 332 rotatably support the planetary gears 320 by way of metal bearings.

The planet carrier 330 has its front end rotatably supported by a housing bearing 440 fixed inside the front end of the housing 400 and a center bracket bearing 370 fixed inside an inner cylindrical portion 365 of the center bracket 360.

(Housing 400)

The housing 400 supports the output shaft 220 with the housing bearing 440 fixed in the front end of the housing 400 and also is provided with a water barrier wall 460 which in order to minimize the incursion of rainwater and the like through the opening portion 410 minimizes the gap at the lower part of the opening portion 410 between the outer diameter of the pinion gear 210 and the housing 400. Also, two slide grooves extending axially are provided at the lower part of the front end of the housing 400, and a shutter 420 which will be further discussed later is disposed in these slide grooves.

(Description of the Shutter 420)

The shutter 420 consisting of a resinous member (for example nylon) is mounted on the output shaft 220 and comprises a ring body 421 sandwiched between the return spring 240 and the pinion gear 210 and a water-barrier portion 422 which opens and closes an opening portion 410 in the housing 400. The operation of the shutter 420 is such that when the starter starts to operate and the pinion gear 210 shifts forward along the output shaft 220 the ring body 421 shifts forward together with the pinion gear 210. When this happens, the water-barrier portion 422 integral with the ring body 421 shifts forward and opens the opening portion 410 of the housing 400. When the starter stops operating and the pinion gear 210 shifts backward along the output shaft 220, the ring body 421 also shifts backward together with the pinion gear 210. When this happens, the water-barrier portion 422 integral with the ring body 421 also shifts backward and closes the opening portion 410 of the housing 400. As a result, the shutter 420, which constitutes opening and closing means, by means of the water-barrier portion 422 prevents rainwater and the like which is splashed by the centrifugal force of the ring gear 100 from getting inside the housing 400 when the starter is not operating.

(Motor 500)

The motor 500 is enclosed by a yoke 501 having a through hole 503, motor spacer wall 800, and a brush holding member 900 which will be discussed later. The motor spacer wall 800 houses the planetary gear speed reduction mechanism 300 between itself and the center bracket 360, and also fulfills the role of preventing lubricating oil inside the planetary gear speed reduction mechanism 300 from getting into the motor 500.

The motor 500, as shown in FIG. 1, is made up of an armature 540 comprising the armature shaft 510 and an armature core 520 and armature coils 530 which are mounted on and rotate integrally with this armature shaft 510, and fixed poles 550 which rotate the armature 540, and the fixed poles 550 are mounted around the inside of the yoke 501.

(Armature Coils 530)

Figure 7:
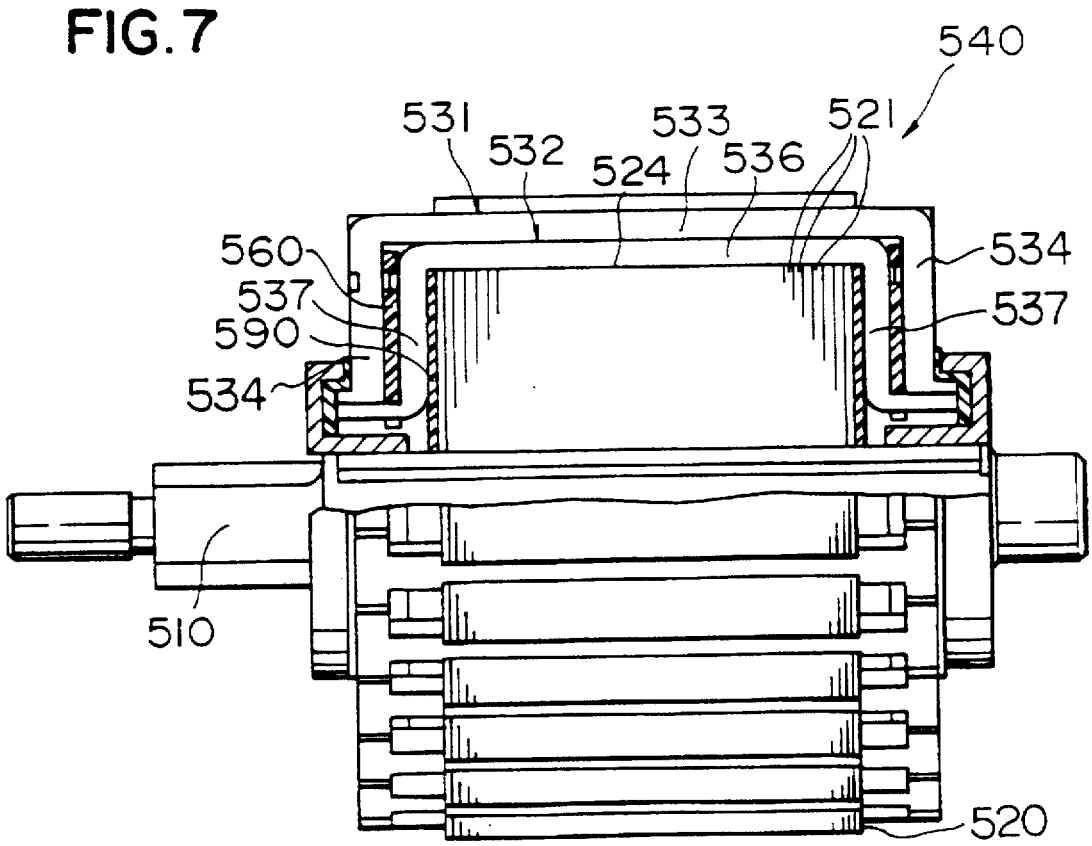
FIG. 7 is a sectional side view of an armature.

For the armature coils 530, in this embodiment shown in detail in FIG. 7, multiple (for example 25) upper layer coil bars 531 and the same number of lower layer coil bars 532 as these upper layer coil bars 531 are used, and 2-layer-winding coils wherein the respective upper layer coil bars 531 and the lower layer coil bars 532 are stacked in the radial direction are employed. The upper layer coil bars 531 and lower layer coil bars 532 are paired, and the ends of the upper layer coil bars 531 and the ends of the lower layer coil bars 532 are electrically connected to constitute ring-shaped coils.

(Upper Layer Coil Bars 531)

The upper layer coil bars 531, as shown in FIG. 7, are made of a material having excellent electrical conductivity (for example copper), and are each provided with an upper layer coil arm 533 which extends axially in parallel with the fixed poles 550 and is held in the outer sides of slots 524 and two upper layer coil ends 534 which are bent inward from both ends of the upper layer coil arm 533 and extend in a direction orthogonal to the axial direction of the armature shaft 510. The upper layer coil arm 533 and the two upper layer coil ends 534 may be a member integrally molded by cold casting, may be a member shaped by bending in a press into a U-shape, or may be a member formed by joining an upper layer coil arm 533 and two upper layer coil ends 534 made as separate parts by a joining method such as welding.

(Lower Layer Coil Bars 532)

The lower coil bars 532, like the upper coil bars 531, are made from a material having excellent electrical conductivity (for example copper), and each comprise a lower layer coil arm 536 which extends axially in parallel with respect to the fixed poles 550 and is held in the inner sides of slots 524 and two lower layer coil ends 537 which are bent inward from the ends of this lower layer coil arm 536 and extend orthogonal to the axial direction of the armature shaft 510. The lower layer coil arm 536 and the two lower layer coil ends 537, like the upper layer coil bar 531, may be a member integrally molded by cold casting, may be a member shaped by bending in a press into a U-shape, or may be a member formed by joining a lower layer coil arm 536 and 2 lower layer coil ends 537 made as separate parts by a joining method such as welding.

Insulation between the upper layer coil ends 534 and the lower layer coil ends 537 is secured by insulating spacers 560, and insulation between the lower layer coil ends 537 and the armature core 520 is secured by an insulating ring 590 made of resin (for example nylon or phenol resin).

(Yoke 501)

Figure 8:
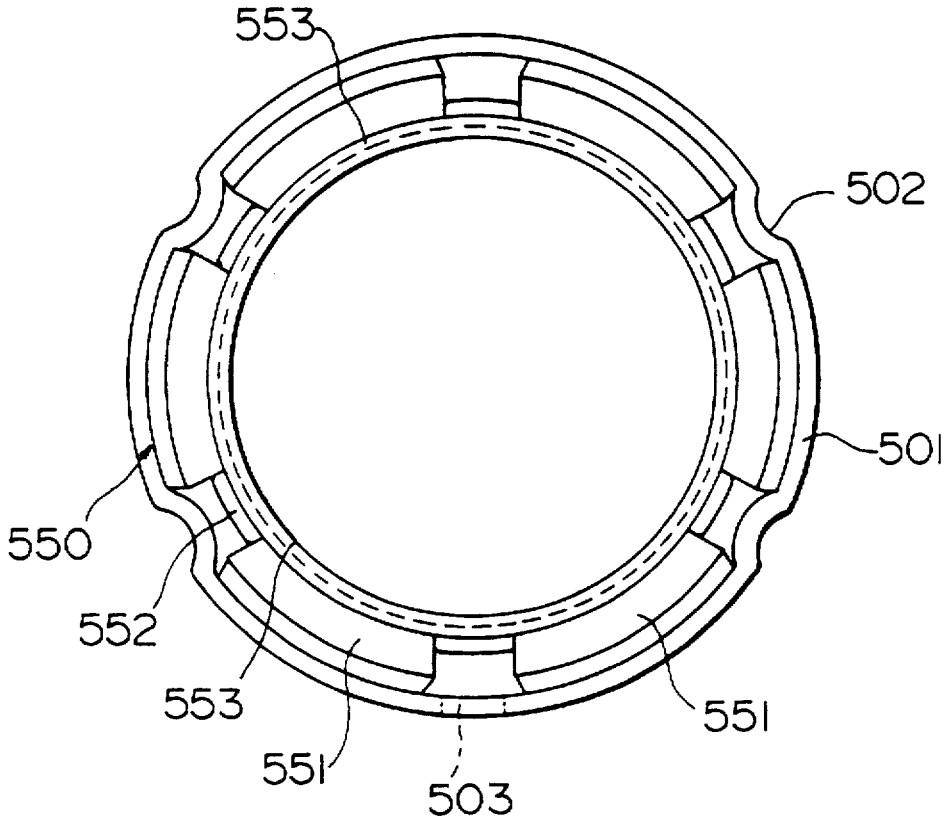
FIG. 8 is a front view of a yoke.

The yoke 501, as shown in FIG. 8, is a cylindrical body formed by rolling a steel plate, and around it are formed a plurality of concave grooves 502 extending axially and sunk toward the inner circumference. These concave grooves 502, as well as disposing through bolts, are used for positioning fixed poles 550 around the inner circumference of the yoke 501.

(Fixed Poles 550)

In this embodiment permanent magnets are used for the fixed poles 550 and, as shown in FIG. 8, they comprise a plurality of (for example 6) main poles 551 and inter-pole poles 552 disposed between these main poles 551. Field coils which generate magnetic force by electrical current flow may be used instead of permanent magnets for the fixed poles 550.

The main poles 551 are positioned by the ends of the inner sides of channel grooves 502 in the above-mentioned yoke 501, and are fixed in the yoke 501 by fixing sleeves 553 disposed around the inside of the fixed poles 550 with the inter-pole poles 552 disposed between the main poles 551.

(Description of the Magnet Switch 600)

Figure 9:
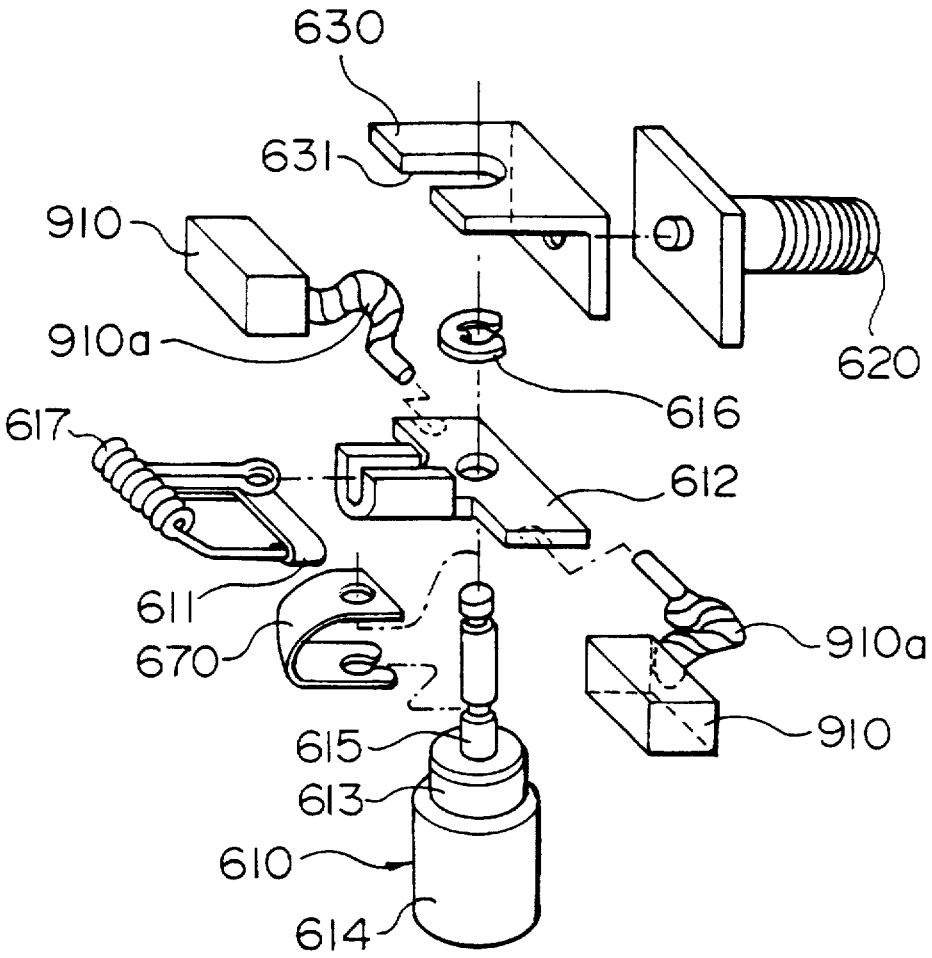
FIG. 9 is an exploded perspective view of a plunger and contact points of a magnet switch.
Figure 10:
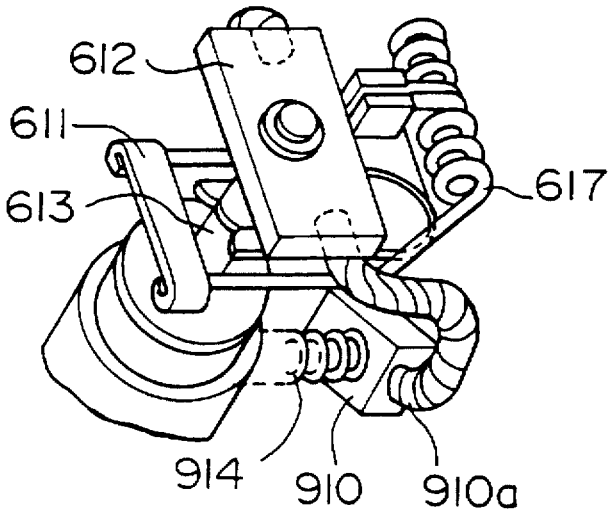
FIG. 10 is a perspective view showing a plunger of a magnet switch.

The magnet switch 600, as shown in FIG. 1, FIG. 9 and FIG. 10, is held in a brush holder 900 which will be discussed later, is disposed inside an end frame 700 which will be discussed later, and is fixed so as to be substantially orthogonal to the armature shaft 510.

In the magnet switch 600, electrical current drives a plunger 610 upward, and two contacts (a lower movable contact 611 and an upper movable contact 612) which move together with the plunger 610 are sequentially caused to abut with the head portion 621 of a terminal bolt 620 and an abutting portion 631 of a fixed contact 630. A battery cable not shown in the drawings is connected to the terminal bolt 620.

The magnet switch 600 is structured inside a magnet switch cover 640 which is cylindrical and has a bottom and is made from magnetic parts (for example made of iron). The magnet switch cover 640 is for example a pliable steel plate press-formed into a cup shape, and in the center of the bottom of the magnet switch cover 640 there is a hole 641 through which the plunger 610 passes movably in the vertical direction. Also, the upper opening of the magnet switch cover 640 is closed off by a stationary core 642 made of a magnetic body (for example made of iron).

The stationary core 642 consists of an upper large diameter portion 643, a lower middle diameter portion 644, and a still lower small diameter portion 645, and the stationary core 642 is fixed in the upper opening of the magnet switch cover 640 by the outer periphery of the large diameter portion 643 being caulked to the inner side of the upper end of the magnet switch cover 640. The upper end of an attracting coil 650 is fitted around the middle diameter portion 644. The upper end of a compression coil spring 660 which urges the plunger 610 downward is fitted around the periphery of the small diameter portion 645 of the stationary core 642.

The attracting coil 650 is attracting means which generates magnetism when a current flows through it and attracts the plunger 610, and the attracting coil 650 is provided with a sleeve 651 which has its upper end fitted to the middle diameter portion 644 of the stationary core 642 and covers the plunger 610 slidably in the vertical direction. This sleeve 651 is made by rolling up a non-magnetic thin plate (for example copper plate, brass, stainless steel), and insulating washers 652 made of resin or the like are provided at the upper and lower ends of this sleeve 651. Around the sleeve 651 between these 2 insulating washers 652 there is wound a thin insulating film (not shown in the drawings) made of resin (for example cellophane, nylon film) or paper, and around that insulating film is wound a predetermined number of turns of a thin enamel wire, whereby the attracting coil 650 is constituted.

The plunger 610 is made of a magnetic metal (for example iron) and has a substantially cylindrical shape comprising an upper small diameter portion 613 and a lower large diameter portion 614. The lower end of the compression coil spring 660 is fitted to the small diameter portion 613, and the large diameter portion 614, which is relatively long in the axial direction, is held slidably vertically in the sleeve 651.

A plunger shaft 615 extending upward from the plunger 610 is fixed to the upper end of the plunger 610. This plunger shaft 615 projects upward through a through hole provided in the stationary core 642. An upper movable contact 612 is fitted around the plunger shaft 615 above the stationary core 642 slidably vertically along the plunger shaft 615. This upper movable contact 612, as shown in FIG. 9, is limited by a stopping ring 616 fitted to the upper end of the plunger shaft 615 so that it does not move upward of the upper end of the plunger shaft 615. As a result, the upper movable contact 612 is vertically slidable along the plunger shaft 615 between the stopping ring 616 and the stationary core 642. The upper movable contact 612 is urged upward at all times by a contact pressure spring 670 consisting of a sheet plate spring fitted to the plunger shaft 615.

The upper movable contact 612 is made of a metal such as copper having excellent conductivity, and when both ends of the upper movable contact 612 move upward they abut with the two abutting portions 631 of the fixed contact 630. The lead wires 911 of a pair of brushes 910 are electrically and mechanically fixed to the upper movable contact 612 by caulking or welding or the like. Also, the end portion of a resistor member 617 constituting a plurality of (in this embodiment, two) limiting means is inserted and electrically and mechanically fixed in a groove portion of the upper movable contact 612.

The lead wires 911 are electrically and mechanically fixed to the upper movable contact 612 by caulking or welding, but the upper movable contact 612 and the lead wires 911 of the brushes 910 may alternatively be formed integrally.

The resistor member 617 is for rotating the motor 500 at low speed when the starter starts to operate, and consists of a metal wire of high resistance wound through several turns. A lower movable contact 611 located below the head portion 621 of the terminal bolt 620 is fixed by caulking or the like to the other end of the resistor member 617.

The lower movable contact 611 is made of a metal such as copper having excellent conductivity, and when the magnet switch 600 stops and the plunger 610 is in its downward position abuts with the upper surface of the stationary core 642, when the resistor member 617 moves upward along with the movement of the plunger shaft 615, before the upper movable contact 612 abuts with the abutting portion 631 of the fixed contact 630 it abuts with the head portion 621 of the terminal bolt 620.

The lower surface of the plunger 610 is provided with a recess portion 682 which accommodates a sphere 681 provided at the rear end of the cord-shaped member 680 (for example a wire). A female thread 683 is formed on the inner wall of this female thread 683. A fixing screw 684 which fixes the sphere 681 in the recess portion 682 is screwed into this recess portion 682. This fixing screw 684 is also used to perform adjustment of the length of the cord-shaped member 680, by adjusting the extent to which the fixing screw 684 is screwed into the female thread 683. The length of the cord-shaped member 680 is adjusted so that when the plunger shaft 615 moves upward and the lower movable contact 611 abuts with the terminal bolt 620 the regulating claw 231 of the pinion rotation regulating member 230 mates with the projections 214 of the outer periphery of the pinion gear 210. The female thread 683 and the fixing screw 684 constitute an adjusting mechanism.

With such a construction, because with respect to the movement of the plunger 610 of the magnet switch 600, via the cord-shaped member 680, the pinion rotation regulating member 230 is moved to the pinion gear 210 side, conventional link mechanisms and levers and the like are not necessary and the number of parts can be reduced, and also even if the pinion gear 210 fails to move away from the ring gear 100, bending in the cord-shaped member 680 itself causes the plunger 610 to return to its original position, and the upper movable contact 612 can move away from the fixed contact 630.

Also, because all that is necessary is to cause the regulating claw 231 of the pinion rotation regulating member 230 to engage with the projections 214 on the pinion gear 210, this regulating claw 231 can be reliably moved by the cord-shaped member 680.

By making the cord-shaped member 680 a wire, the durability can be increased.

Also, by disposing the adjusting mechanism consisting of the female thread 683 and the fixing screw 684 between the plunger 610 and the cord-shaped member 680 and screwing the fixing screw 684 into the female thread 683, the length of the cord-shaped member 680 can be easily adjusted.

Also, because the lead wires 910*a* of the brushes 910 are directly connected to the upper movable contact 612, heat generated at the brushes 910 is efficiently radiated via the lead wires 910*a*, the upper movable contact 612 and the terminal bolt 620 from the battery cable connected to the terminal bolt 620 and positioned outside the starter, and increases in the life of the brushes 910 can be attempted.

Furthermore, because the plunger shaft 615 of the magnet switch 600 is disposed substantially orthogonal to the motor axis, compared to a case wherein the plunger shaft 615 of the magnet switch 600 is disposed axially, the axial direction dimension of the starter can be shortened and the stroke through which the plunger shaft 615 is required to pull the cord-shaped member 680 can be set small, and further downsizing of the magnet switch 600 can be attempted.

Furthermore, because the plunger 615 of the magnet switch 600 is disposed orthogonal with respect to the axial direction of the armature shaft 510, only the diametral direction length of the magnet switch 600 adds to the axial direction length of the overall starter, and the build of the whole starter is not made large.

Furthermore, because the magnet switch 600 is housed inside the end frame 700, it does not readily suffer damage from water and the like which has entered through the opening 410 in the housing 400.

(End Frame 700)

Figure 11:
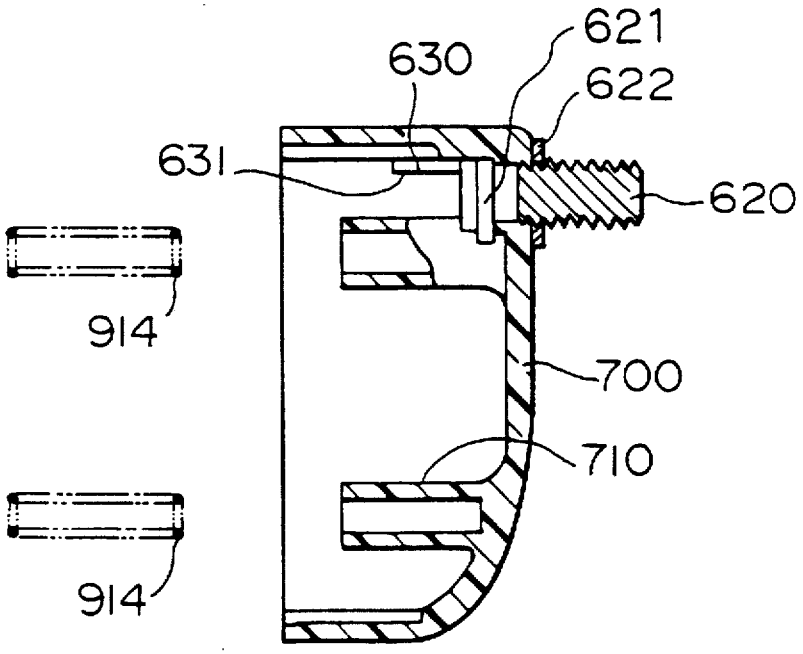
FIG. 11 is a sectional view of an end frame and a brush spring.

The end frame 700, as shown in FIG. 11, is a magnet switch cover made of resin (for example phenol resin), and accommodates the magnet switch 600.

Spring holding pillars 710 which hold compression coil springs 914 which urge the brushes 910 forward are mounted projecting from the rear surface of the end frame 700 in correspondence with the positions of the brushes 910.

Also, the compression coil springs 914, as shown in FIG. 1, are disposed radially outward with respect to the axial direction of the plunger 610 of the magnet switch 600.

The terminal bolt 620 is a steel bolt which passes through the end frame 700 from the inside and projects from the rear of the end frame 700 and has at its front end a head portion 621 which abuts with the inner surface of the end frame 700. The terminal bolt 620 is fixed to the end frame 700 by a caulking washer 622 being attached to the terminal bolt 620 projecting rearward of the end frame 700. A copper fixed contact 630 is fixed to the front end of the terminal bolt 620 by caulking. The fixed contact 630 has one or a plurality of (in this embodiment, two) abutting portions 631 positioned at the top end of the inside of the end frame 700, and these abutting portions 631 are mounted so that the upper surface of the upper movable contact 612 which is moved up and down by the operation of the magnet switch 600 can abut with the lower surfaces of the abutting portions 631.

Further, the spring length of the compression coil springs 914 can use the radial direction length of the magnet switch 600, a suitable spring stress and load can be set, and the life of the compression coil springs 914 can be greatly increased.

(Brush Holder 900)

The brush holder 900, as well as the roles of separating the inside of the yoke 501 and the inside of the end frame 700 and rotatably supporting the rear end of the armature shaft 510 by way of the brush holder bearing 564, also fulfills the role of a brush holder, the role of holding the magnet switch 600, and the role of holding a pulley 690 which guides the cord-shaped member 680. The brush holder 900 has a hole portion not shown in the drawings through which the cord-shaped member 680 passes.

Figure 12:
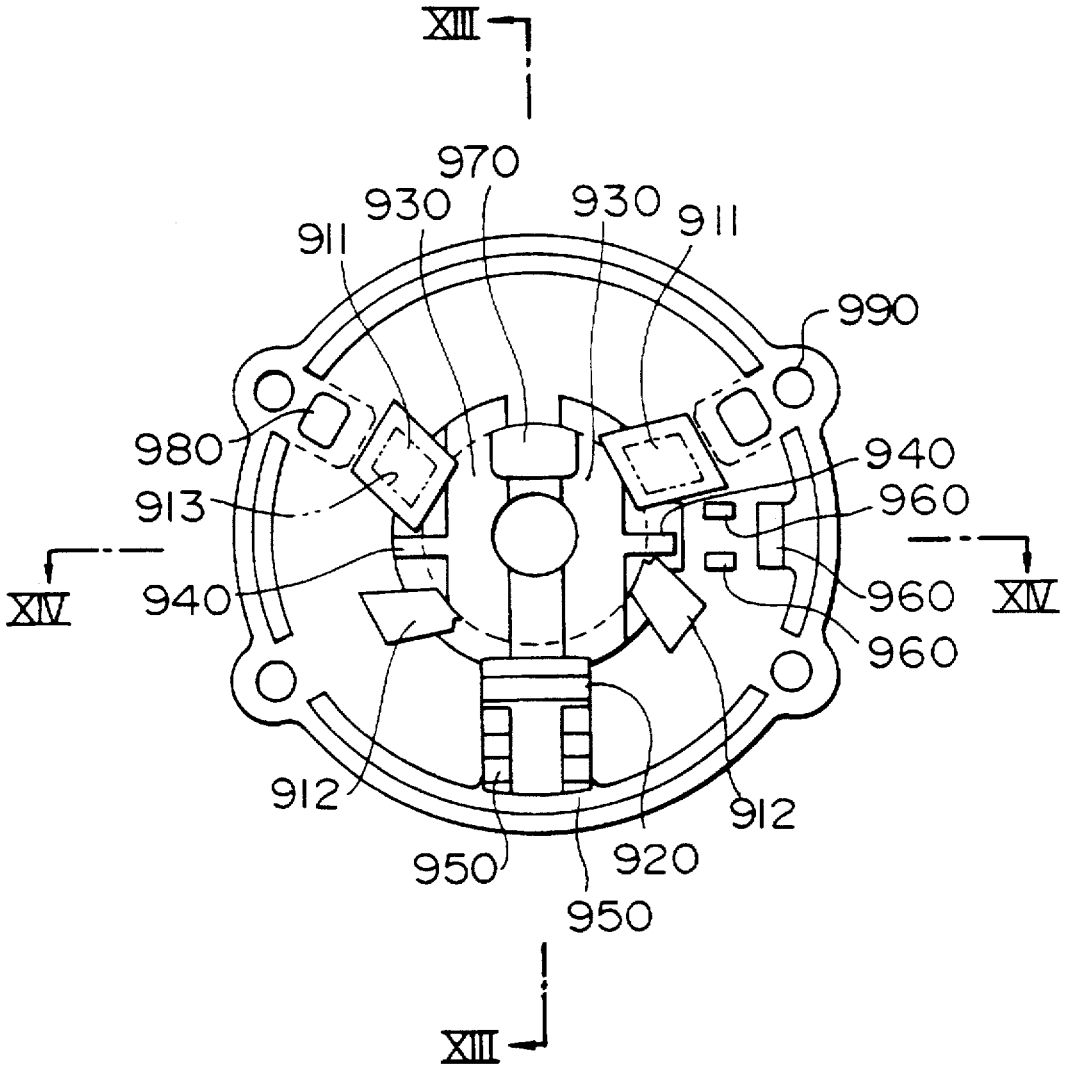
FIG. 12 is a front view of a brush holder.
Figure 13:
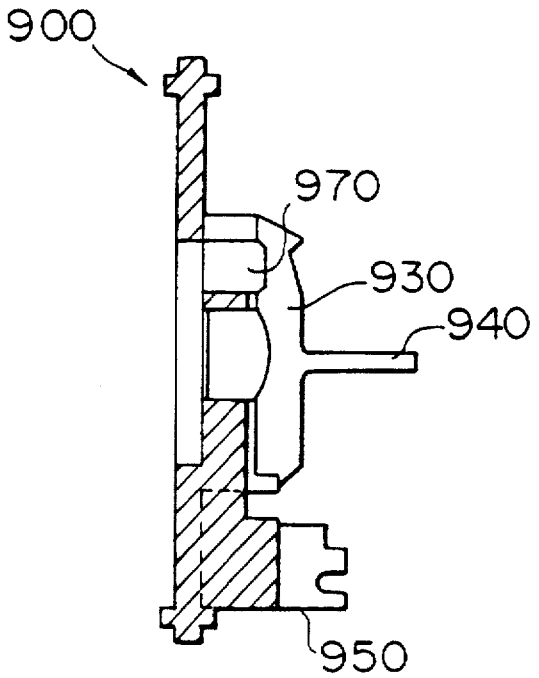
FIG. 13 is a sectional view taken along the line XIII—XIII in FIG. 12.
Figure 14:
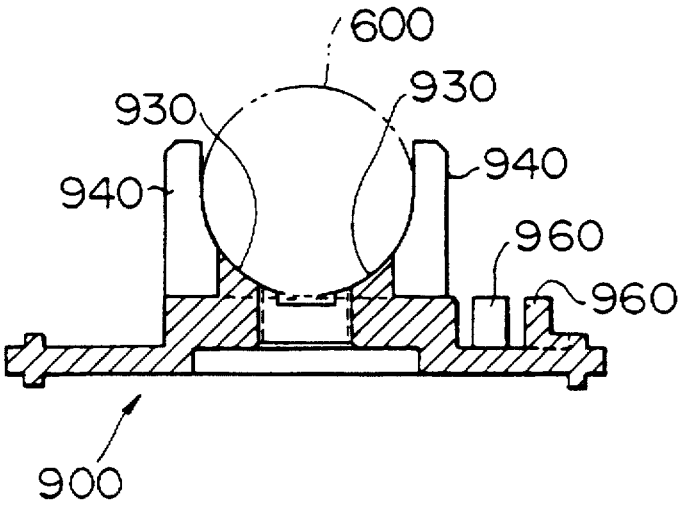
FIG. 14 is a sectional view taken along the line XIV—XIV in FIG. 12.

The brush holder 900 is a spacing wall made of a metal such as aluminum molded by a casting method and, as shown in FIG. 12 through FIG. 14, has a plurality of (in this embodiment, two upper and two lower) brush holding holes 911, 912 which hold the brushes 910 in the axial direction. The upper brush holding holes 911 are holes which hold brushes 910 which receive a plus voltage, and these upper brush holding holes 911 hold the brushes 910 by way of resin (for example nylon, phenol resin) insulating cylinders 913 (FIG. 13 is a cross-section taken along XIII—XIII of FIG. 12, and FIG. 14 is a cross-section taken along XIV—XIV of FIG. 12). The lower brush holding holes 912 are holes which hold brushes 910 connected to ground, and these lower brush holding holes 912 hold the respective brushes 910 directly therein.

In this way, by holding the brushes 910 by means of the brush holder 900, there is no need to provide the starter with independent brush holders. As a result, the number of parts in the starter can be reduced and assembly man-hours can be reduced.

The brushes 910 are urged against the upper layer coil ends 534 at the rear ends of the armature coils 530 by the compression coil springs 914.

The lead wires 910*a* of the upper brushes 910 are electrically and mechanically joined by a joining method such as welding or caulking to the upper movable contact 612 which is moved by the magnet switch 600. The lead wires 910*a* of the lower brushes 910 are caulked and thereby electrically and mechanically joined to a concave portion 920 formed in the rear surface of the brush holder 900. In this embodiment a pair of lower brushes 910 are provided, one lead wire 910*a* is connected to the pair of lower brushes 910, and the middle of the lead wire 910*a* is caulked in the concave portion 920 formed in the rear surface of the brush holder 900.

Two seats 930 with which the front side of the magnet switch 600 abuts and two fixing pillars 940 which hold the periphery of the magnet switch 600 are formed on the rear side of the brush holder 900.

The seats 930 are shaped to match the external shape of the magnet switch 600 in order to abut with the magnet switch 600, which has a cylindrical exterior. The two fixing pillars 940, with the magnet switch 600 in abutment with the seats 930, by having their rear ends caulked to the inner side, hold the magnet switch 600.

A pulley holding portion 950 which holds a pulley 690 which converts the direction of movement of the cord-shaped member 680 from the vertical direction of the magnet switch 600 into the axial direction thereof is formed on the lower side of the rear side of the brush holder 900.

(Operation)

Next, the operation of the starter described above will be explained with reference to the electrical circuit diagrams FIGS. 15A through 15C.

Figure 15A:
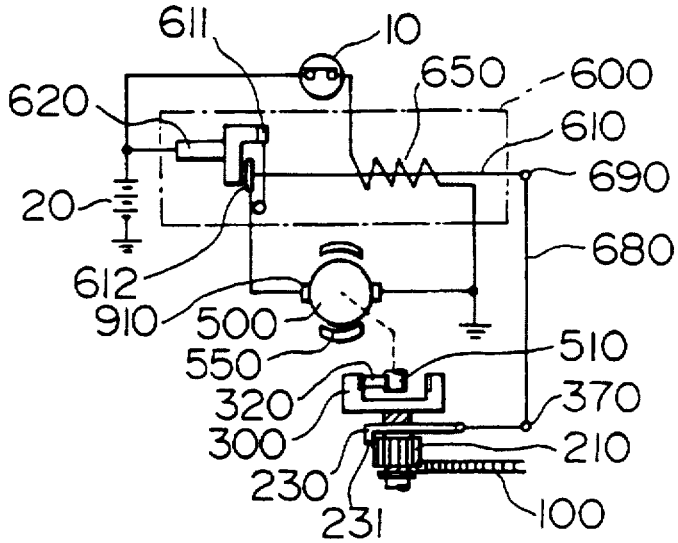
FIGS. 15A through 15C are electrical circuit diagrams in which the operating state of a pinion is shown.

When a key switch 10 is set to the start position by a driver as shown in FIG. 15A, electricity flows from a battery 20 to the attracting coil 650 of the magnet switch 600. When current flows through the attracting coil 650, the plunger 610 is pulled by the magnetic force produced by the attracting coil 650, and the plunger 610 ascends from its lower position to its upper position (from right to left in FIG. 15A).

When the plunger 610 starts to ascend, together with the ascent of the plunger shaft 615 the upper movable contact 612 and the lower movable contact 611 ascend, and the rear end of the cord-shaped member 680 also ascends. When the rear end of the cord-shaped member 680 ascends, the front end of the cord-shaped member 680 is pulled down, and the pinion rotation regulating member 230 descends. When the descent of the pinion rotation regulating member 230 causes the regulating claw 231 to mate with the projections 214 of the periphery of the pinion gear 210, the lower movable contact 611 abuts with the head portion 621 of the terminal bolt 620. The voltage of the battery 20 is impressed on the terminal bolt 620, and the voltage of the terminal bolt 620 is transmitted through the lower movable contact 611→the resistor member 617→the upper movable contact 612→the lead wires 910*a* to the upper brushes 910. That is, the low voltage passing through the resistor member 617 is transmitted through the upper brushes 910 to the armature coils 530. Because the lower brushes 910 are constantly grounded through the brush holder 900, a current flows at low voltage through the armature coils 530 constituted in coil form by the paired upper layer coil bars 531 and lower layer coil bars 532. When this happens, the armature coils 530 generate a relatively weak magnetic force, this magnetic force acts on (attracts or repels) the magnetic force of the fixed poles 550, and the armature 540 rotates at low speed.

When the armature shaft 510 rotates, the planetary gears 320 of the planetary gear speed reduction mechanism 300 are rotationally driven by the sun gear 310 on the front end of the armature shaft 510. When the planetary gears 320 exert a rotational torque through the planet carrier 330 on the internal gear 340 in the direction which rotationally drives the ring gear 100, the rotation of the internal gear 340 is limited by the operation of the overrunning clutch 350. That is, because the internal gear 340 does not rotate, the rotation of the planetary gears 320 causes the planet carrier 330 to rotate at low speed. When the planet carrier 330 rotates, the pinion gear 210 also rotates, but because the pinion gear 210 has its rotation limited by the pinion rotation regulating member 230 the pinion gear 210 advances along the helical spline 221 on the output shaft 220.

Together with the advance of the pinion gear 210, the shutter 420 also advances, and opens the opening portion 410 of the housing 400. The advance of the pinion gear 210 causes the pinion gear 210 to mesh completely with the ring gear 100 and then abut with the pinion stopping ring 250. Also, when the pinion gear 210 advances, the regulating claw 231 disengages from the projections 214 of the pinion gear 210 and after that the front end of the regulating claw 231 drops to the rear side of the washer 215 disposed on the rear side of the pinion gear 210.

Figure 15B:
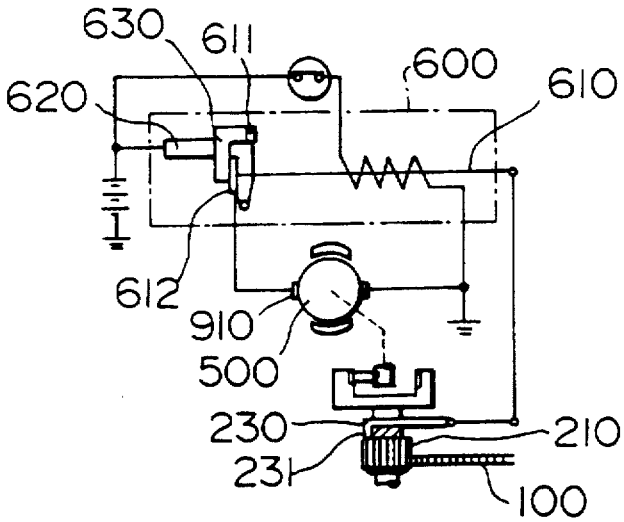

With the pinion gear 210 advanced, the upper movable contact 612 abuts with the abutting portion 631 of the fixed contact 630 as shown in FIG. 15B. When this happens, the battery voltage of the terminal bolt 620 is directly transmitted through the upper movable contact 612→the lead wires 910*a* to the upper brushes 910. That is, a high current flows through the armature coils 530 consisting of the upper coil bars 531 and the lower coil bars 532, the armature coils 530 generate a strong magnetic force and the armature 540 rotates at high speed.

The rotation of the armature shaft 510 is slowed and has its rotational torque increased by the planetary gear speed reduction mechanism 300 and rotationally drives the planet carrier 330. At this time, the front end of the pinion gear 210 abuts with the pinion stopping ring 250 and the pinion gear 210 rotates integrally with the planet carrier 330. Because the pinion gear 210 is meshing with the ring gear 100 of the engine, the pinion gear 210 rotationally drives the ring gear 100 and rotationally drives the output shaft of the engine.

Next, when the engine starts and the ring gear 100 of the engine rotates faster than the rotation of the pinion gear 210, the action of the helical spline creates a force tending to retract the pinion gear 210. However, the regulating claw 231 which has dropped to behind the pinion gear 210 prevents the pinion gear 210 from retracting, prevents early disengagement of the pinion gear 210, and enables the engine to be started surely.

When the engine starting causes the ring gear 100 to rotate faster than the rotation of the pinion gear 210, the rotation of the ring gear 100 rotationally drives the pinion gear 210. When this happens, the rotational torque transmitted from the ring gear 100 to the pinion gear 210 is transmitted through the planet carrier 330 to the pins 332 which support the planetary gears 320. That is, the planetary gears 320 are driven by the planet carrier 330. When this happens, because a torque rotationally opposite to that during engine starting is exerted on the internal gear 340, the overrunning clutch 350 allows the rotation of the ring gear 100. That is, when a torque rotationally opposite to that during engine starting is exerted on the internal gear 340, the roller 353 of the overrunning clutch 350 detaches to outside the concave portion 355 of the clutch inner 352 and rotation of the internal gear 340 becomes possible.

In other words, the relative rotation with which the ring gear 100 rotationally drives the pinion gear 210 when the engine starts is absorbed by the overrunning clutch 350, and the armature 540 is never rotationally driven by the engine.

Figure 15C:
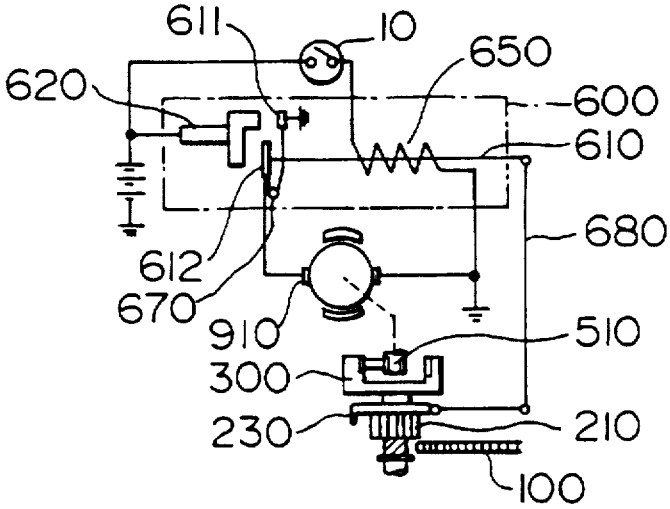

When the engine starts, the driver releases the key switch 10 from the start position as shown in FIG. 15C and the flow of current to the attracting coil 650 of the magnet switch 600 is stopped. When the flow of current to the attracting coil 650 stops, the plunger 610 is returned downward by the action of the compression coil spring 660.

When this happens, the upper movable contact 612 moves away from the abutting portion 631 of the fixed contact 630, and after that the lower movable contact 611 also moves away from the head portion 621 of the terminal bolt 620, and the flow of current to the upper brushes 910 is stopped.

When the plunger 610 is returned downward, the action of the return spring portion 236 of the pinion rotation regulating member 230 causes the pinion rotation regulating member 230 to return upward, and the regulating claw 231 moves away from the rear of the pinion gear 210. When this happens, the pinion gear 210 is returned rearward by the action of the return spring 240, the meshing of the pinion gear 210 with the ring gear 100 of the engine is disengaged, and the rear end of the pinion gear 210 abuts with the flange-like projecting portion 222 of the output shaft 220. That is, the pinion gear 210 is returned to the position it was in before the starter was started.

Also, the plunger 610 being returned downward causes the lower movable contact 611 to abut with the upper surface of the stationary core 642 of the magnet switch 600, and the lead wires of the upper brushes 910 conduct electrical current in the order the upper movable contact 612→the resistor member 617→the lower movable contact 611→the stationary core 642→the magnet switch cover 640→the brush holder 900. In other words, the upper brushes 910 and the lower brushes 910 short-circuit through the brush holder 900. Meanwhile, inertial rotation of the armature 540 generates an electromotive force in the armature coils 530. Because this electromotive force is short-circuited through the upper brushes 910, the brush holder 900 and the lower brushes 910, a braking force is exerted on the inertial rotation of the armature 540. As a result, the armature 540 rapidly stops.

(Advantages)

In the starter of this embodiment as described with reference to FIG. 1, FIG. 2, FIGS. 3A and 3B, when the pinion rotation regulating member 230 constituting pinion regulating means abuts with the pinion 200 and the rotation of the output shaft 220 moves the pinion gear 210 to the ring gear side and the pinion gear 210 abuts with the ring gear 100, the pinion regulating means itself bends and allows the pinion gear 210 to gradually rotate and mesh with the ring gear and consequently there is no generation of abrasion powder and a simple constitution with few parts can be adopted.

Also, because the axial grooves 213 with which the regulating claw 231 of the pinion rotation regulating member 230 engages are more numerous than the gear number of the pinion gear 210, it can easily engage with the axial grooves.

Furthermore, because the pinion rotation regulating member 230 need only hold the pinion gear 210 with the small force required to regulate the rotation of the pinion gear 210, the pinion rotation regulating member 230 can be moved to the pinion gear 210 side by the magnet switch 600 by way of the cord-shaped member 680, and the freedom with which the magnet switch 600 is disposed can be increased.

Also, the regulating claw 231 of the pinion rotation regulating member 230 itself can attain the pinion return prevention when the pinion gear 210 has meshed with the ring gear 100, and the number of parts can be made small and the assembly can be simplified.

Furthermore, because the pinion rotation regulating member 230 itself integrally comprises the return spring portion 233 constituting urging means for urging the movement to the opposite side to the pinion gear 210, by switching the magnet switch 600 OFF, by means of the spring portion 233, the pinion rotation regulating member 230 moves away from the pinion gear 230, and the number of parts can be made small and the assembly can be simplified.

Because until the pinion gear 210 abuts with the ring gear 100 the resistor member 617 constituting limiting means makes the rotation of the output shaft 220 slow and the pinion gear 210 is moved to the ring gear 100 side slowly, it is not necessary to make the rigidity of the pinion rotation regulating member 230 strong, and it is possible to make the shock when the pinion gear 210 abuts with the ring gear 100 small.

Also, by holding the washer 215 rotatably on the end surface of the pinion gear 210, even when the pinion gear 210 is over-run by the ring gear 100 and rotates at high speed, because the washer 215 is rotatable with respect to the pinion gear 210, there is little wear on the abutting portion of the regulating claw 231 of the pinion rotation regulating member 230, and the durability can be increased.

Furthermore, because the washer 215 is heat-treated simultaneously with the pinion gear 210, it is possible to dispense with a process for making the hardness of the washer 215 above a predetermined value.

Also, by the movement of the plunger 610 of the magnet switch 600, by causing the regulating claw 231 to abut with the pinion gear 210 while causing the return spring portion 233 constituting urging means to move, by means of the compression force of the return spring 233, the regulating claw 231 can be reliably moved away from the pinion gear 210 side.

Second Embodiment

Figure 16:
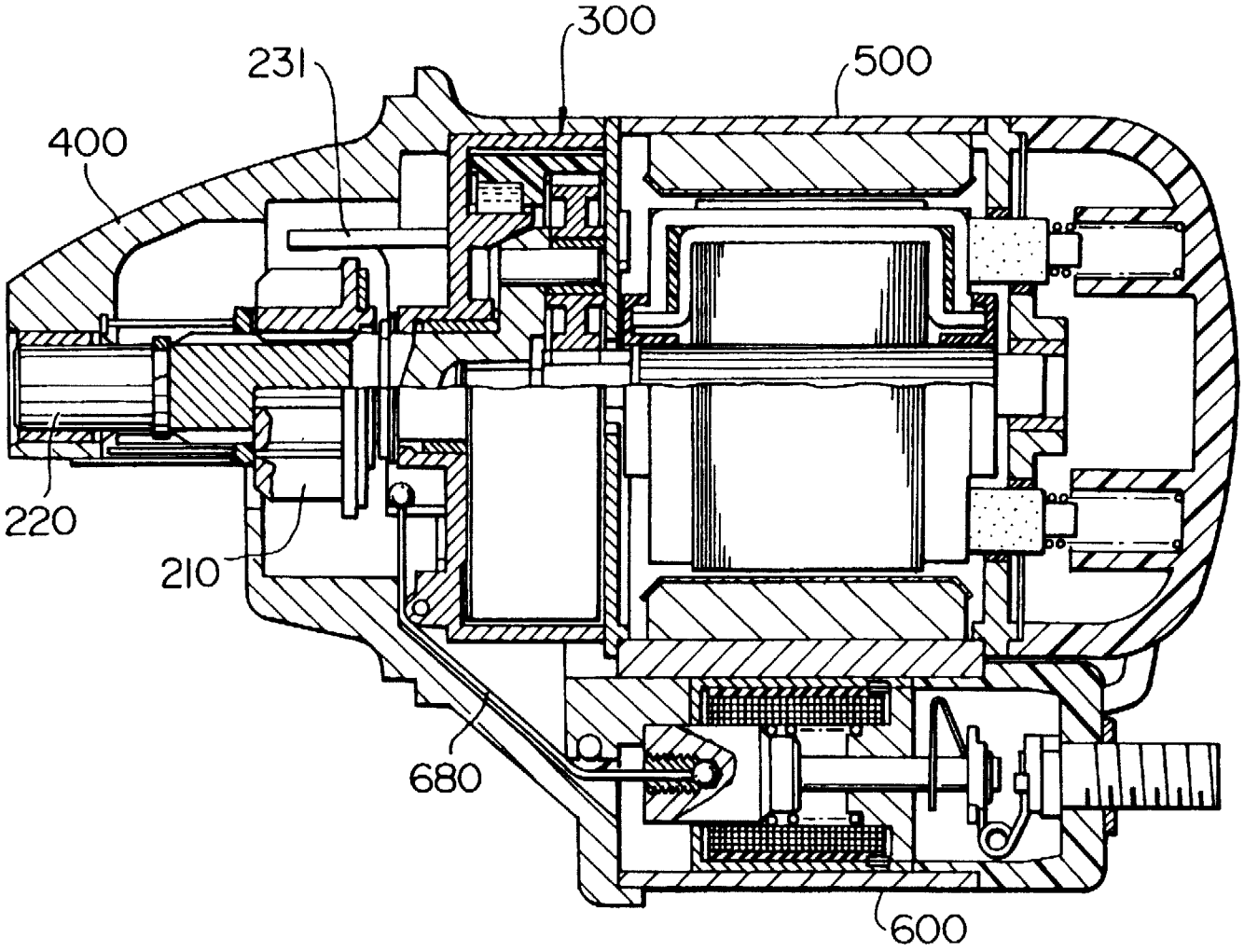
FIG. 16 is a sectional view of the second embodiment of the present invention.

In the second embodiment shown in FIG. 16, the magnet switch 600 in embodiment 1 is disposed parallel to the motor 500 and the pinion rotation regulating member 230 is operatively linked with the magnet switch 600 through the wire 680.

Third Embodiment

Figure 17A:
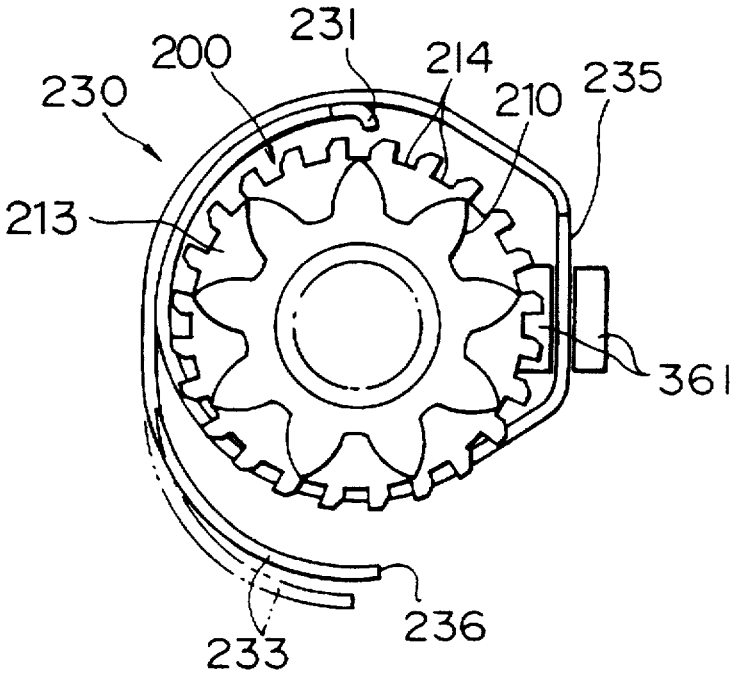
FIGS. 17A and 17B are a front view and a partial side sectional view showing a pinion according to the third embodiment.
Figure 17B:
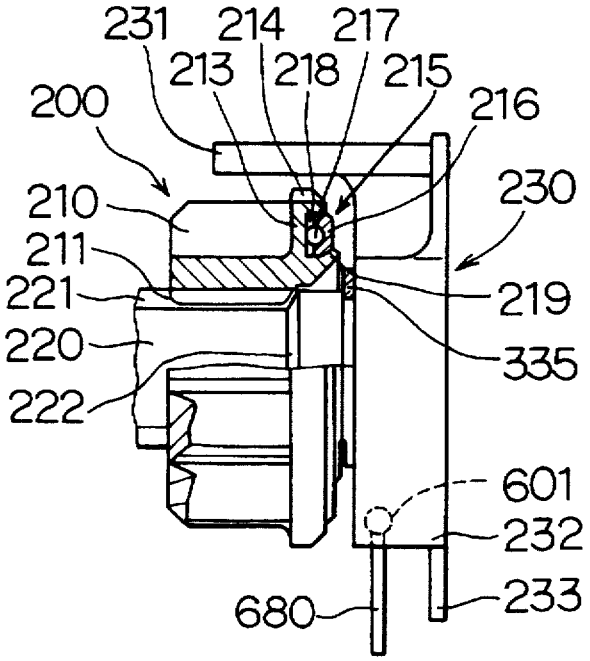

According to this embodiment shown in FIGS. 17A and 17B, in place of the washer 215 used in the first and second embodiments, a thrust bearing 215 (absorbing means) is mounted on the rear end of the flange 213 to absorb the difference in rotational speeds of the pinion 200 and a return/rotation regulating claw 231. According to the embodiment, a bearing which bears axially applied load is called as a thrust bearing.

The thrust bearing 215 in this embodiment uses a rolling bearing and is comprised of an orbital ring 216 which is to be abutted by the front end of the return/rotation regulating claw 231 and a plurality of balls 217 rotatable between the orbital ring 216 and the rear face of the flange 213. By the rotation of the balls 217, the rotational difference between the pinion 200 and the return/rotation regulating claw 213 is absorbed. The balls 217 may be made of steel but preferably made of ceramics to improve durability.

The thrust bearing 215 is mounted in a recess 218 formed on the rear face of the flange 213, and then an annular portion 219 formed on the rear end of the pinion 200 is bent outwardly so that it is kept rotatably on the rear face of the flange 213 and unable to come off in the axial direction.

By the rotatable thrust bearing 215 being mounted on the rear face of the flange 213 of the pinion 200 in this way, when the rotation regulating member 230 which will be discussed later drops in behind the pinion 200, the front end of the return/rotation regulating claw 231 abuts the orbital ring 216 of the thrust bearing 215. As a result, the rotation of the pinion 200 is absorbed by the thrust bearing 215 and the rotation torque of the pinion 200 is not transmitted to the return/rotation regulating claw 231. Thus, this prevents generation of wear, heat and rotation loss between the pinion 200 and thr return/rotation regulating claw 231.

Further, when the pinion 200 is driven by the ring gear 100 and rotated at a higher speed than the output shaft 220 to cause a speed difference by which a force is applied to return the pinion 200 rearward, a large load is applied between the pinion 200 and the return/rotation regulating claw 231. Since this rotational difference is absorbed by the thrust bearing 215, wear, heat generation and rotational loss between the pinion 200 and the return/rotation regulating claw 231 can be reduced.

(Advantages)

In the state in which the return/rotation regulating claw 231 is positioned rearward the pinion 200 and the return of the pinion 200 from the ring gear 100 is regulated, the thrust bearing 215 absorbs the difference between the rotational speed of the pinion 200 and that of the return/rotation regulating claw 231. Because the rotation of the pinion 200 is absorbed by the thrust bearing 215, and the rotation torque of the pinion 200 is prevented from being transmitted to the return/rotation regulating claw 231, generation of wear, heat, and rotation loss between the pinion 200 and return/rotation regulating claw 231 can be prevented. Further, when the pinion 200 is driven by the ring gear 100 and rotates at a higher speed than the output shaft 220 and consequently the force for moving the pinion 200 rearward is applied to the pinion 200 due to the difference in the rotational speeds, a great load is applied between the pinion 200 and the return/rotation regulating claw 231. The thrust bearing 215, however, absorbs the difference between the rotational speeds, the generation of wear, heat, and rotation loss between the pinion 200 and return/rotation regulating claw 231 can be prevented, which allows the performance of the starter to be maintained for a long time.

In this embodiment, because the thrust bearing 215 comprises an orbital ring 216 and a rolling bearing composed of the orbital ring 216 and a plurality of spheres 217, the rotational force is transmitted to the return/rotation regulating claw 231 at a very small degree. Thus, even though the return/rotation regulating claw 231 having a low rigidity is used, there is no disadvantage that the return/rotation regulating claw 231 is damaged by the engagement into the rotation of the pinion 200. Moreover, because the rigidity of the return/rotation regulating claw 231 is allowed to be low, the force of the magnet switch 600 for operating the return/rotation regulating claw 231 can be reduced and hence, the magnet switch 600 can be allowed to be compact and light.

According to this embodiment, the pinion 200 can be moved in the axial direction of the output shaft 220 which drives the pinion 200, and the weight of the moving member (pinion 200+thrust bearing 215) can be allowed to be smaller by about ⅕ than that of the conventional moving member (pinion+pinion shaft). Further, because the pinion 200 can be moved axially by utilizing the rotational force of the motor 500, the force required for the magnet switch 600 is the force for operating the movable contacts 611 and 612 plus the force for operating the return/rotation regulating claw 231. Thus, the force to be generated by the magnet switch 600 is much smaller than that to be generated by the conventional one. Therefore, the magnet switch 600 can be made smaller and lighter than the conventional one.

In addition, because the weight of the moving member can be allowed to be smaller by about ⅕ than that of the conventional one, the energy for moving the pinion 200 can be allowed to be smaller than that for moving the conventional one. Because of this, the energy required for actuating the starter can be reduced and hence, the load to be applied to a power unit (lead storage battery, electric double-layer capacitor or the like) for driving the starter can be reduced. Consequently, the power unit can be allowed to be smaller and have a longer life than the conventional one.

Moreover, because the weight of the moving member can be allowed to be smaller by about ⅕ than that of the conventional one, the shock generated when the pinion 200 engages the ring gear 100 can be reduced.

The pinion 200 is heat-treated after the thrust bearing 215 is mounted thereon. Therefore, it is unnecessary to subject the orbital ring 216 of the thrust bearing 215 to heat treatment separately, which eliminates the need for a process of increasing the hardness of the orbital ring 216 to more than a predetermined value.

Further, the return/rotation regulating claw 231 is positioned rearward the pinion 200 because it exceeds the expansion force of the return spring portion 233 by the movement force of the plunger 610 of the magnet switch 600. Thus, when the magnet switch 600 is turned off, the return/rotation regulating claw 231 can be securely disengaged from the rear portion of the pinion 200 owing to the expansion force of the return spring 233.

Fourth Embodiment

Figure 18:
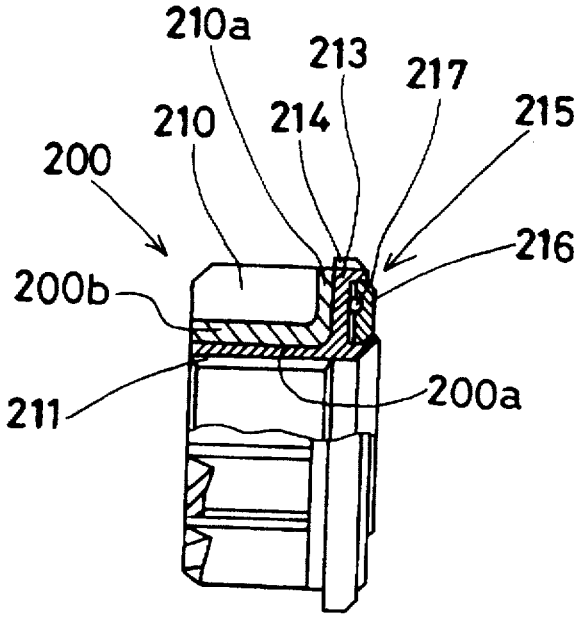
FIG. 18 is a side sectional view showing a pinion according to the fourth embodiment.
Figure 19:
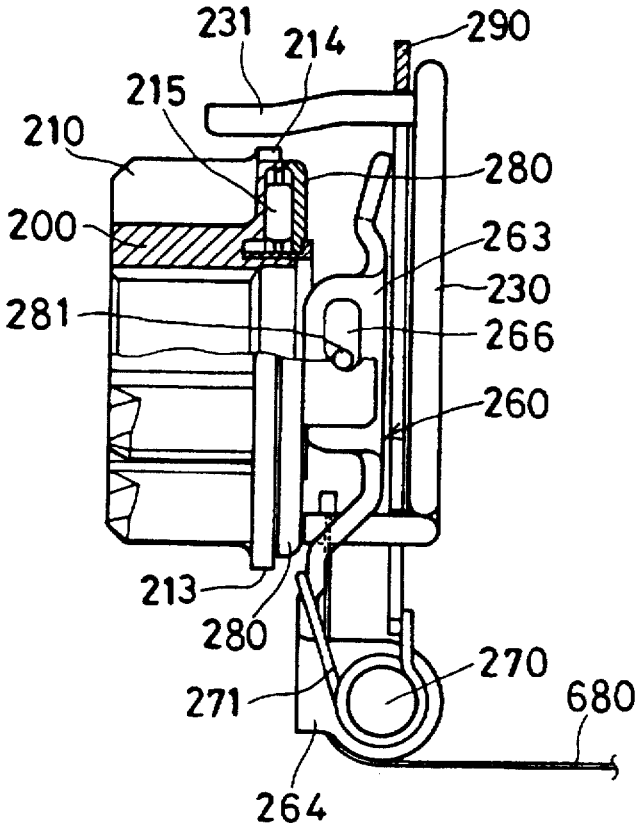
FIG. 19 is a partial sectional view showing a rotation regulating member and a return regulating member according to the fifth embodiment.
Figure 20:
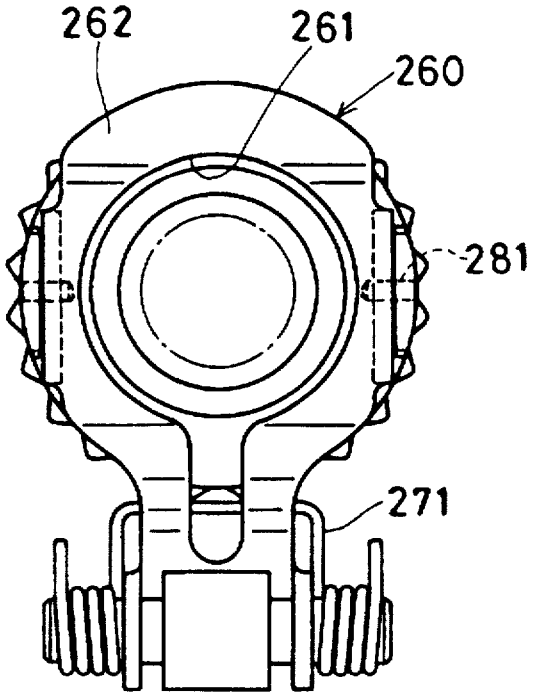
FIG. 20 is a front view of FIG. 19.

FIG. 18 shows the fourth embodiment in a sectional view of a pinion 200 having a thrust bearing 215 mounted thereon.

In the abovedescribed embodiments, the pinion gear 210 (outer teeth) is formed on the peripheral face of one member and the helical inner spline 211 (inner teeth) is formed on the inner peripheral face thereof. Unlike the foregoing embodiments, in a pinion 200 of this embodiment, a pinion inner member 200*a* provided with a helical inner spline 211 on the inner peripheral face thereof and a pinion outer member 200*b* provided with a pinion gear 210 on the peripheral face thereof are separately produced, and then nonrotatably fixed with each other. As an example of a method of fixing the two members 200*a* and 200*b*, press fitting method may be utilized after providing a whirl-stop (for example, key way) between the pinion inner member 200*a* and the pinion outer member 200*b* or welding method may be used.

In the first to third embodiments, it is difficult to form both the pinion gear 210 and the helical inner spline 211 on one member by cold forging. Thus, in the first to third embodiments, the pinion gear 210 which is the external teeth has to be formed by machining. In this fourth embodiment, however, those can be formed by cold forging, respectively, which results in a reduction in manufacturing cost.

Furthermore, the pinion inner member 200*a* can be connected with many kinds of pinion outer members 200*b*. Therefore, many kinds of pinions 200 can be manufactured by preparing many kinds of pinion outer members 200*b*. That is, in the case of pinion gear 210, many kinds of specifications are required according to the specification of the engine, whereas in the case of the helical inner spline 211, only one kind or a few kinds of specifications are required. Thus, many kinds of pinions 200 can be manufactured in combination of the pinion inner member 200*a* and the pinion outer member 200*b* provided separately, which provides many kinds of starters corresponding to many kinds of engines. Further, the pinion inner member 200*a* can be mass-produced, which leads to the production of the pinion 200 in low cost.

The pinion 200 of this embodiment is heavier than that of the first and second embodiments because of a cold forging-caused shear droop portion 210*a* of the pinion outer member 200*b*, but the weight of the pinion 200 of this embodiment is much lighter than that of the conventional pinion moving member. Thus, the fourth embodiment can provide the similar operation and effect as in the first embodiment.

Fifth Embodiment

FIGS. 19 through 22 show a fifth embodiment in which a rotation regulating member and a return regulating member are provided separately, and a needle bearing is used for the thrust bearing 215. The construction of the return regulating member of this embodiment is different from that of the return regulating member of the foregoing embodiments. The construction of the return regulating member of this embodiment will be described below.

A return regulating member 260 (corresponding to return regulating means) comprises an annular portion 262 (FIG. 19) having a circular hole 261 formed at the center thereof to receive an output shaft 220 therethrough; side portions 263 bent at right angle to the annular portion 262 at both sides thereof; and a pivotal support 264 pivotably supported by a supporting pin 270 fixed to a center bracket 360. The return regulating member 260 is constructed by mating the supporting pin 270 with a hole 265 (FIG. 21) formed on the pivotal support 264 and by mating an engaging pin 281 provided on a thrust ring 280 with a slot 266 formed on the side portion 263, so that the return regulating member 260 is rotatable or pivotable around the supporting pin 270.

The return regulating member 260 is pressed toward a plate 290 by a spring 271 mating with the supporting pin 270. That is, the spring 271 presses the pinion 200 rearward (toward the plate 290) through the return regulating member 260, thus maintaining a stationary state and contributing to preventing the pinion 200 from moving forward when the engine is started.

Figure 21:
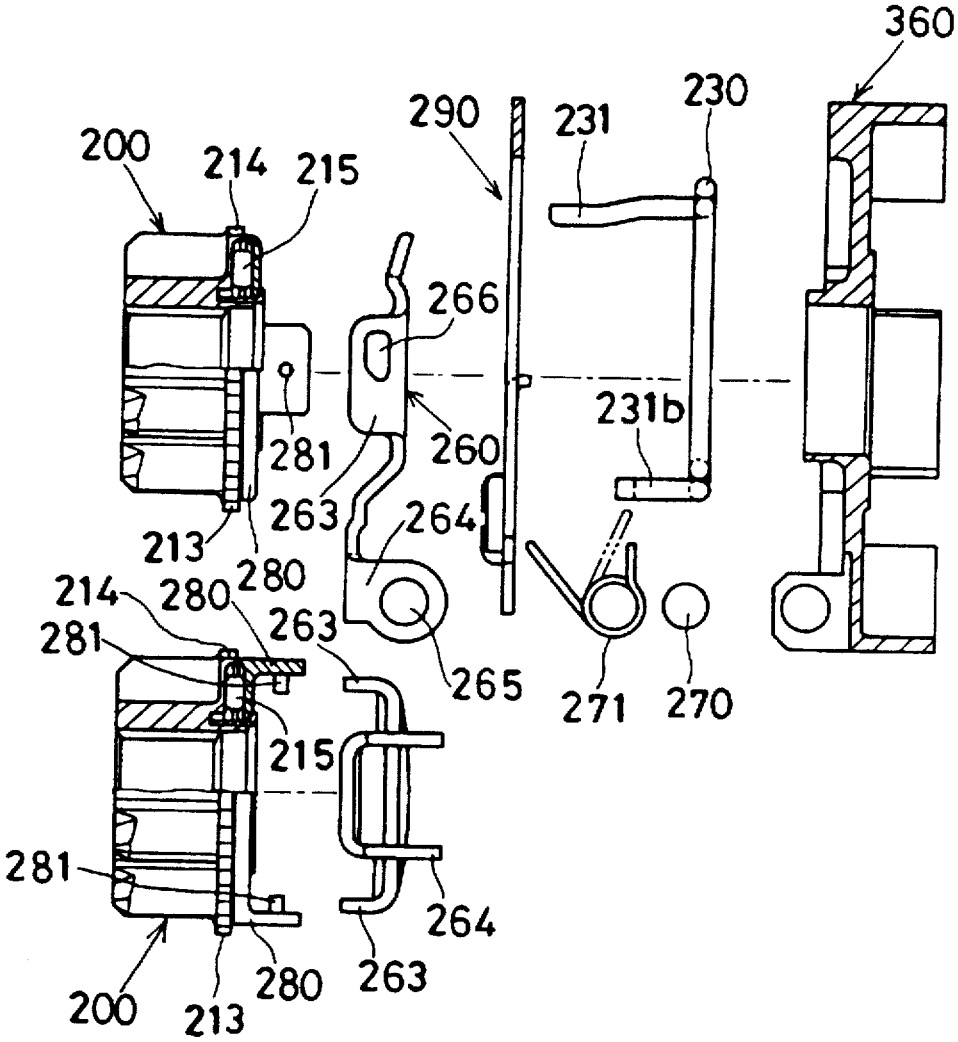
FIG. 21 is an exploded view of FIG. 19.
Figure 22:
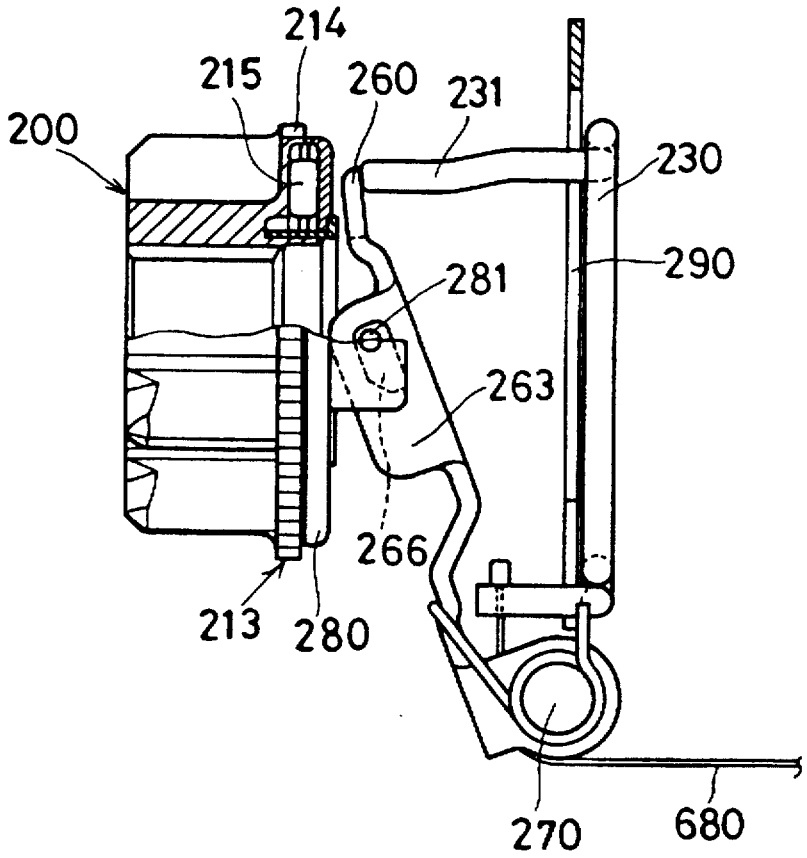
FIG. 22 is an explanatory view of the operation of a return regulating member according to the fifth embodiment.

As shown in FIG. 21, the rotation regulating member 230 of this embodiment is formed of a circular rod-shaped metal material, and both ends thereof are bent perpendicularly in the same direction at opposite positions in a radial direction thereof. One end of the bent portion serves as a rotation regulating bar 231*a* which engages convexes/concaves 214 of the pinion 200 to stop rotation of the pinion 200 at an initial time in the actuation of the starter, whereas one end of a cord-shaped member 680 engages the other end 231*b* of the rotation regulating member 230 to transmit the operation of the magnet switch 600 therethrogh. Further, as shown in FIG. 22, when the return regulating member 260 is inclined axially by a forward movement of the pinion 200, the rotation regulating bar 231*a* enters into a rear portion of the annular portion 262 of the return regulating member 260, thus maintaining the posture of the return regulating member 260 by supporting an end of the annular portion 262.

The operation of this embodiment is described below.

Similarly to the foregoing embodiments, when a starter switch is turned on, the magnet switch 600 is actuated, and consequently, the rotation regulating bar 231*a* of the rotation regulating member 230 engages the convexes/concaves 214 of the pinion gear 210, thus regulating the rotation of the pinion 200.

Receiving the rotational force of the starter motor 500, the output shaft 220 rotates and the rotation-regulated pinion 200 advances on the helical spline. As a result, the pinion 200 engages the ring gear 100 to start the engine.

As shown in FIG. 22, at this time, the return regulating member 260 biased by the spring 271 is inclined axially around the supporting pin 270 by the advance of the pinion 200, with the engaging pin 281 mounted on thrust ring 280 and slot 266 formed on the side portion 263 engaging each other.

When the pinion 200 engages the ring gear 100 completely, the leading end of the rotation regulating bar 231*a* disengages from the convexes/concaves 214 of the pinion 200 and is placed at the rear side of the thrust ring 280, thus permitting the rotation of the pinion 200 and supporting the rear end of the return regulating member 260. Therefore, the posture of the return regulating member 260 inclined axially by being pulled by the thrust ring 280 is maintained.

Owing to the above, when the pinion 200 is rotated by the ring gear 100 and a retraction force is applied to the pinion 200, the retraction of the pinion 200 can be prevented by the cooperation of the return regulating member 260 and the rotation regulating member 230.

Thereafter, when the starter switch is turned off, the rotation regulating member 230 is raised up in FIG. 22 and returned to the original position by the force of the return spring. As a result, the leading end of the rotation regulating bar 231 disengages from the rear end of the return regulating member 260, thus returning the pinion 200 to the stationary state (FIG. 19) together with the return regulating member 260.

In this embodiment, the return regulating member 260 is rotatably mounted relative to the pinion 200 through the thrust ring 280, and the rotational force of the pinion 200 is not applied to the rotation regulating bar 231*a* supporting the rear end of the return regulating member 260. Therefore, the rotation regulating bar 231 is prevented from being bent or worn. Further, because the side portions 263 of the return regulating member 260 contact the rear end face of the thrust ring 280 at both positions in a radial direction thereof, the pinion 200 is supported by two points. Owing to this, the pinion 200 can be prevented from being inclined with respect to the output shaft 220 and hence, a reliable operation can be provided.

Modifications

Although in each of the embodiments only the pinion 200 engages the helical outer spline 221 of the output shaft 220, it is possible to design a starter to have a pinion moving member composed of the pinion 200 and separate functional parts (for example, one-way clutch or the like) mounted thereon and engageable with the helical outer spline 221 of the output shaft 220.

Other modifications and alterations are of course possible for those skilled in the art without departing from the spirit and scope of the invention.

What is claimed is:

1. A starter comprising:

an output shaft formed with a helical outer spline on an outer periphery thereof and rotatably driven;

a pinion having a helical inner spline mounted on an inner periphery thereof and movable in an axial direction of the output shaft with the helical inner spline thereof being in mesh with the helical outer spline, the pinion further having a pinion gear formed on an outer periphery thereof for engagement with a ring gear of an engine;

a motor for generating a rotational power when energized and rotating the output shaft thereby to move the pinion axially by a difference between a rotational speed of the output shaft and that of the pinion, when the motor is energized, and engage the pinion with the ring gear;

return regulating means adapted to be moved to one axial side of the pinion, when the pinion is in mesh with the ring gear, thereby to regulate a return of the pinion in an axial direction thereof; and a thrust bearing provided between the pinion and the return regulating means to absorb a difference between a rotational speed of the pinion and that of the return regulating means.

2. A starter according to claim 1, further comprising:

pinion regulating means adaped to regulate a rotation of the pinion by abutting the pinion, the pinion regulating means moving into a rear side of the pinion to work as the return regulating means when the pinion moves a predetermined distance in mesh with the ring gear.

3. A starter according to claim 1, wherein:

the pinion includes;

a pinion inner member formed with the helical inner spline; and a pinion outer member formed with the pinion gear and rotatable together with the pinion inner member.

4. A starter according to claim 1, wherein:

the thrust bearing includes a rolling bearing.

5. A starter according to claim 1, wherein:

the thrust bearing includes a sliding bearing.

6. A starter comprising:

an output shaft having a helical spline thereon;

a pinion moving member having a pinion engageable with a ring gear of an engine and engaged with the helical spline of the output shaft to be axially movable on the output shaft;

a motor for driving the output shaft;

rotation regulating means for moving the pinion to a ring gear side to engage the pinion with the ring gear by regulating a rotation of the pinion moving member when the motor is energized;

return regulating means for regulating a return of the pinion from the ring gear only when the pinion is in engagement with the ring gear; and absorbing means provided between the pinion and the return regulating means to absorb a difference between a rotational speed of the pinion and that of the return regulating means.

7. A starter according to claim 6, wherein:

absorbing means includes one of a rolling bearing and a sliding bearing provided on the pinion moving member.

8. A starter according to claim 7, wherein:

the rotation regulating means is adapted to move to a side opposite to the ring gear side, when the pinion moves to the gear ring side by a predetermined distance, thereby to work as the return regulating means.

9. A starter comprising:

an output shaft having a helical spline thereon;

a pinion moving member having a pinion engageable with a ring gear of an engine and engaged with the helical spline of the output shaft to be axially movable on the output shaft;

a motor for driving the output shaft;

rotation regulating means for moving the pinion to a ring gear side to engage the pinion with the ring gear by regulating a rotation of the pinion moving member when the motor is energized;

return moving and regulating means for regulating a return of the pinion from the ring gear when the pinion is in engagement with the ring gear; and a bearing including one of a rolling type and a sliding type and mounted on the pinion moving member to be abutted by the return regulating means.

10. A starter comprising:

a pinion engageable with a ring gear of an engine;

a motor for transmitting a rotating force to the pinion;

a pinion moving member for moving the pinion to a ring gear side;

return regulating means for regulating a return of the pinion from the ring gear only after the pinion is in engagement with the ring gear; and absorbing means provided between the pinion moving member and the return regulating means and absorbing a difference between a rotational speed of the pinion and that of the return regulating means.

11. A starter according to claim 10, wherein the return regulating means is movable in a direction perpendicular to a direction of a movement of the pinion.

12. A starter according to claim 10, wherein the return regulating means is rigid.

13. A starter according to claim 10, wherein the absorbing means is integral with the pinion moving member.

14. A starter according to claim 1, wherein said return regulating means selectively prevents return of the pinion.

15. A starter according to claim 6, wherein said return regulating means selectively prevents return of the pinion.

16. A starter according to claim 9, wherein said return regulating means selectively prevents return of the pinion.

17. A starter according to claim 10, wherein said return regulating means selectively prevents return of the pinion.

* * * * *